US010240543B2

(12) United States Patent
Kleczewski et al.

(10) Patent No.: US 10,240,543 B2
(45) Date of Patent: Mar. 26, 2019

(54) INTEGRATED IGNITION AND ELECTRONIC AUTO-CHOKE MODULE FOR AN INTERNAL COMBUSTION ENGINE

(71) Applicant: Kohler Co., Kohler, WI (US)

(72) Inventors: Michael Robert Kleczewski, Cleveland, WI (US); Michael J. Tursky, Fond du Lac, WI (US); Pezaan Sham Patrawala, Vadodara (IN); Awadhesh Kumar Thakur, Sheboygan, WI (US)

(73) Assignee: KOHLER CO.

( * ) Notice: Subject to any disclaimer, the term of this patent is extended or adjusted under 35 U.S.C. 154(b) by 0 days.

(21) Appl. No.: 15/258,679

(22) Filed: Sep. 7, 2016

(65) Prior Publication Data

US 2016/0377009 A1 Dec. 29, 2016

Related U.S. Application Data

(63) Continuation of application No. 14/460,095, filed on Aug. 14, 2014, now Pat. No. 9,464,588.
(Continued)

(51) Int. Cl.
*F02M 1/02* (2006.01)
*F01P 3/00* (2006.01)
(Continued)

(52) U.S. Cl.
CPC ..... *F02D 41/067* (2013.01); *F02D 1/02* (2013.01); *F02D 31/007* (2013.01);
(Continued)

(58) Field of Classification Search
CPC ..... F02D 41/067; F02D 41/1441; F02D 41/0097; F02D 41/1454; F02D 41/1486;
(Continued)

(56) References Cited

U.S. PATENT DOCUMENTS 2,684,057 A 7/1954 Bolton
3,534,720 A 10/1970 Dubois
(Continued)

FOREIGN PATENT DOCUMENTS

CA 1150384 7/1983
CN 2330795 7/1999
(Continued)

OTHER PUBLICATIONS

Chinese Office Action and English language Summary for related application No. CN 201480001412.5, dated Feb. 4, 2017.
(Continued)

*Primary Examiner* — Geroge Jin
(74) *Attorney, Agent, or Firm* — The Belles Group, P.C.

(57) ABSTRACT

An integrated ignition and electronic auto-choke module for an internal combustion engine and an internal combustion engine including the same. In one aspect, the module includes a housing that is configured to be mounted to an engine block of an internal combustion engine. The housing may contain at least a portion of a first temperature sensor that measures a first temperature indicative of an engine temperature. The housing may also contain a controller and at least a portion of an ignition circuit. The controller may be coupled to the first temperature sensor and configured to determine a starting position of a choke valve based on the first temperature and operate an actuator to move the choke valve into the starting position accordingly.

16 Claims, 21 Drawing Sheets

Related U.S. Application Data

(60) Provisional application No. 61/866,485, filed on Aug. 15, 2013.

(51) Int. Cl.

| | |
|---|---|
| ***F02D 41/06*** | (2006.01) |
| ***F02D 31/00*** | (2006.01) |
| ***F02M 1/08*** | (2006.01) |
| ***F02D 41/00*** | (2006.01) |
| ***F02D 41/14*** | (2006.01) |
| ***F02M 1/10*** | (2006.01) |
| ***F02D 1/02*** | (2006.01) |
| ***F02P 1/08*** | (2006.01) |

(52) U.S. Cl.
CPC ..... *F02D 41/0097* (2013.01); *F02D 41/144* (2013.01); *F02D 41/1441* (2013.01); *F02D 41/1454* (2013.01); *F02D 41/1486* (2013.01); *F02M 1/02* (2013.01); *F02M 1/08* (2013.01); *F02M 1/10* (2013.01); *F02P 1/086* (2013.01); *F02D 2200/021* (2013.01); *F02D 2200/0414* (2013.01); *F02D 2200/101* (2013.01)

(58) Field of Classification Search
CPC ..... F02D 2200/021; F02D 2200/101; F02M 1/02; F02M 1/10; F02P 1/086; F02P 1/083; F02P 3/0407; F02P 3/06; F02P 3/08
See application file for complete search history.

(56) References Cited

U.S. PATENT DOCUMENTS 3,652,869 A 3/1972 Holt
3,699,937 A 10/1972 Petris
3,732,856 A 5/1973 Firey
3,752,133 A 8/1973 Irish et al.
3,768,453 A 10/1973 Hurst
3,780,718 A 12/1973 Nambu et al.
3,789,815 A 2/1974 Schreiner
3,791,358 A 2/1974 Masaki et al.
3,806,854 A 4/1974 Armstrong
3,807,172 A 4/1974 Masaki
3,818,881 A 6/1974 Hosho et al.
3,861,366 A 1/1975 Masaki et al.
3,872,847 A 3/1975 Charron et al.
3,897,765 A 8/1975 Harrison et al.
3,934,565 A 1/1976 Matsumoto et al.
3,948,240 A 4/1976 Hirosawa et al.
3,956,433 A 5/1976 Garcea
3,960,130 A 6/1976 Peterson
3,972,311 A 8/1976 DePetris
4,003,355 A 1/1977 Kamiezaki et al.
4,005,690 A 2/1977 Hirosawa et al.
4,009,695 A 3/1977 Ule
4,010,722 A 3/1977 Laprade et al.
4,011,844 A 3/1977 Hirosawa et al.
4,019,470 A 4/1977 Asano
4,027,640 A 6/1977 Hirosawa et al.
4,038,955 A 8/1977 Paulmier
4,048,964 A 9/1977 Kissel
4,050,424 A 9/1977 Nelson
4,058,097 A 11/1977 Hutton et al.
4,081,499 A 3/1978 Ishii et al.
4,083,336 A 4/1978 Armstrong et al.
4,096,837 A 6/1978 Iiyama et al.
4,111,010 A 9/1978 Minami
4,114,584 A 9/1978 Rogerson et al.
4,118,444 A 10/1978 Abbey
4,181,107 A 1/1980 Nomura et al.
4,237,077 A 12/1980 Berg
4,237,078 A 12/1980 Benjamin
4,271,802 A 6/1981 Hori et al.
4,279,230 A 7/1981 Bauer et al.
4,280,462 A 7/1981 Kuroiwa et al.
4,291,659 A 9/1981 Suzuki et al.
4,292,946 A 10/1981 Masaki
4,307,696 A 12/1981 Noji et al.
4,321,902 A 3/1982 Stoltman
4,331,615 A 5/1982 Walstra et al.
4,344,898 A 8/1982 Takada et al.
4,348,996 A 9/1982 Morozumi
4,349,877 A 9/1982 Oyama et al.
4,351,782 A 9/1982 Bellicardi et al.
4,352,346 A 10/1982 Osano et al.
4,352,347 A 10/1982 Osano et al.
4,383,409 A 5/1983 Otsuka et al.
4,388,905 A 6/1983 Kurihara
4,391,249 A 7/1983 Bianchi et al.
4,391,251 A 7/1983 Planteline et al.
4,393,838 A 7/1983 Muscatell
4,399,792 A 8/1983 Otsuka et al.
4,425,886 A 1/1984 Kuroiwa et al.
4,428,349 A 1/1984 Snow
4,433,665 A 2/1984 Abe et al.
4,450,812 A 5/1984 Otsuka et al.
4,463,723 A 8/1984 Tansuwan
4,475,502 A 10/1984 Matsumoto
4,484,554 A 11/1984 Nakajima et al.
4,487,187 A 12/1984 Petro
4,493,303 A 1/1985 Thompson et al.
4,495,922 A 1/1985 Fujimura et al.
4,496,496 A 1/1985 Walstra
4,497,296 A 2/1985 Nakajima et al.
4,498,440 A 2/1985 Nomura et al.
4,510,907 A 4/1985 Atago et al.
4,522,177 A 6/1985 Kawai et al.
4,524,742 A 6/1985 Bonfiglioli et al.
4,527,527 A 7/1985 Irino et al.
4,545,345 A 10/1985 Pagdin et al.
4,563,990 A 1/1986 Kishida et al.
4,569,321 A 2/1986 Bonfiglioli et al.
4,576,132 A 3/1986 Nakajima et al.
4,591,699 A 5/1986 Sato et al.
4,612,770 A 9/1986 Tadokoro et al.
4,662,333 A 5/1987 Martel
4,699,738 A 10/1987 Depetris
4,730,589 A 3/1988 Ohtaki et al.
4,753,209 A 6/1988 Hibino et al.
4,768,478 A 9/1988 Martel
4,788,014 A 11/1988 Kanno
5,012,780 A 5/1991 Bugamelli
5,031,593 A 7/1991 Erhard et al.
5,136,998 A * 8/1992 Deutsch ..... B60R 16/0239 123/406.4
5,261,382 A 11/1993 Nikolai
5,408,981 A 4/1995 Tomisawa
5,476,132 A 12/1995 Jacobson
5,537,964 A 7/1996 Hoshiba
5,626,118 A 5/1997 Sugii
5,632,248 A 5/1997 Sugii
5,660,765 A 8/1997 King et al.
5,832,888 A 11/1998 Griffiths et al.
5,855,195 A 1/1999 Oikawa et al.
5,992,829 A 11/1999 Andreasson
6,012,420 A 1/2000 Dykstra et al.
6,186,117 B1 2/2001 Matte
6,536,747 B2 3/2003 Burns et al.
6,560,528 B1 5/2003 Gitlin et al.
6,722,638 B2 4/2004 Kohima et al.
6,752,110 B2 6/2004 Tharman et al.
6,830,023 B2 12/2004 Tharman et al.
6,896,245 B2 5/2005 Suzuki et al.
6,932,058 B2 8/2005 Nickel et al.
6,935,308 B1 8/2005 Nakamoto et al.
6,990,969 B2 1/2006 Roth et al.
7,097,163 B2 8/2006 Moriyama et al.
7,117,834 B2 10/2006 Kamimura et al.
7,118,097 B2 10/2006 Moriyama et al.
7,128,036 B2 10/2006 Suzuki
7,128,309 B2 10/2006 Edamatsu et al.
7,144,000 B2 12/2006 Roth et al.

(56) References Cited

U.S. PATENT DOCUMENTS

| | | | | |
|---|---|---|---|---|
| 7,156,376 | B2 | 1/2007 | Bungo et al. | |
| 7,171,947 | B2 | 2/2007 | Fukushima et al. | |
| 7,204,232 | B2 | 4/2007 | Matsuda | |
| 7,213,555 | B2 | 5/2007 | Kamimura et al. | |
| 7,246,591 | B2 | 7/2007 | Shinogi et al. | |
| 7,246,794 | B2 | 7/2007 | Suzuki et al. | |
| 7,284,522 | B2 | 10/2007 | Kamimura et al. | |
| 7,331,326 | B2 | 2/2008 | Arai et al. | |
| 7,344,125 | B2 | 3/2008 | Matsuda et al. | |
| 7,395,811 | B2 | 7/2008 | Bellato et al. | |
| 7,487,608 | B2 | 2/2009 | Yamazaki et al. | |
| 7,525,287 | B2 | 4/2009 | Miyashita et al. | |
| 7,536,991 | B2 | 5/2009 | Kadam et al. | |
| 7,628,387 | B1 | 12/2009 | Clouse et al. | |
| 7,673,402 | B2 | 3/2010 | Wakitani et al. | |
| 7,681,339 | B2 | 3/2010 | Wakitani et al. | |
| 7,798,128 | B2 | 9/2010 | Bellistri et al. | |
| 7,854,216 | B2 | 12/2010 | Kasai et al. | |
| 7,886,716 | B1 | 2/2011 | Arai et al. | |
| 7,997,016 | B2 | 8/2011 | Yamazaki et al. | |
| 8,005,603 | B2 | 8/2011 | Fisher et al. | |
| 8,036,818 | B2 | 10/2011 | Kasai et al. | |
| 8,113,166 | B2 | 2/2012 | Kumagai et al. | |
| 8,146,558 | B2 | 4/2012 | Clouse et al. | |
| 8,215,286 | B2 | 7/2012 | Maekawa et al. | |
| 8,219,305 | B2 | 7/2012 | Iwata et al. | |
| 8,256,396 | B2 | 9/2012 | Emmerich et al. | |
| 8,261,712 | B2 | 9/2012 | Sotiriades | |
| 8,386,149 | B2 | 2/2013 | Bellistri et al. | |
| 8,434,444 | B2 | 5/2013 | Iwata et al. | |
| 8,434,445 | B2 | 5/2013 | Iwata et al. | |
| 8,448,622 | B2 | 5/2013 | Raasch | |
| 8,489,310 | B2 | 7/2013 | Shimamura et al. | |
| 8,495,995 | B2 | 7/2013 | Drew et al. | |
| 8,695,950 | B2 | 4/2014 | Takesue | |
| 2003/0015175 | A1* | 1/2003 | Andersson | F02D 35/0061 123/406.47 |
| 2005/0098907 | A1 | 5/2005 | Richard et al. | |
| 2005/0199217 | A1 | 9/2005 | Kamimura et al. | |
| 2005/0200030 | A1 | 9/2005 | Kamimura et al. | |
| 2006/0102126 | A1* | 5/2006 | Nakata | F02M 1/12 123/179.15 |
| 2006/0266330 | A1 | 11/2006 | Fukushima et al. | |
| 2007/0028881 | A1* | 2/2007 | Nakata | F02M 1/08 123/179.15 |
| 2007/0084444 | A1 | 4/2007 | Bellistri et al. | |
| 2008/0025372 | A1* | 1/2008 | Culbertson | G01K 1/08 374/185 |
| 2008/0053746 | A1 | 3/2008 | Albert | |
| 2008/0245331 | A1 | 10/2008 | Kumagai et al. | |
| 2008/0245339 | A1 | 10/2008 | Kumagai et al. | |
| 2009/0013951 | A1* | 1/2009 | Nakata | F02M 1/12 123/179.14 |
| 2009/0293828 | A1* | 12/2009 | Iwata | F02D 41/067 123/179.18 |
| 2010/0145595 | A1* | 6/2010 | Bellistri | F02D 11/10 701/103 |
| 2010/0269787 | A1 | 10/2010 | Shimamura et al. | |
| 2011/0030640 | A1 | 2/2011 | Raasch | |
| 2011/0088661 | A1 | 4/2011 | Sczomak et al. | |
| 2012/0118254 | A1 | 5/2012 | Leufen et al. | |
| 2012/0161341 | A1 | 6/2012 | Arai | |
| 2013/0000586 | A1 | 1/2013 | Zuo et al. | |
| 2013/0133618 | A1 | 5/2013 | Larsson et al. | |
| 2013/0206093 | A1 | 8/2013 | Visuri et al. | |

FOREIGN PATENT DOCUMENTS

| | | | |
|---|---|---|---|
| CN | 1869422 | A | 11/2006 |
| CN | 101113706 | | 1/2008 |
| CN | 101289971 | | 10/2008 |
| CN | 201225209 | | 4/2009 |
| CN | 201280978 | | 7/2009 |
| CN | 201306223 | | 9/2009 |
| CN | 201321902 | | 10/2009 |
| CN | 201810423 | | 4/2011 |
| CN | 202402169 | | 8/2012 |
| CN | 202402170 | | 8/2012 |
| DE | 102009037294 | | 2/2011 |
| DE | 202011000519 | | 6/2012 |
| EP | 0046599 | | 3/1982 |
| EP | 0115447 | | 8/1984 |
| EP | 0183879 | | 6/1986 |
| EP | 1253308 | | 10/2002 |
| EP | 1835154 | | 9/2007 |
| EP | 2128420 | | 12/2009 |
| EP | 2128420 | A2 | 12/2009 |
| GB | 1446993 | | 8/1976 |
| GB | 1483175 | | 8/1977 |
| GB | 1488452 | | 10/1977 |
| GB | 1490922 | | 11/1977 |
| GB | 1498777 | | 1/1978 |
| GB | 2041086 | | 9/1980 |
| IN | 01030MUM2000 | | 8/2005 |
| JP | 55142952 | | 11/1980 |
| JP | 58119950 | | 7/1983 |
| JP | 58155256 | | 9/1983 |
| JP | 58155260 | | 9/1983 |
| JP | 58048776 | | 10/1983 |
| JP | 58176446 | | 10/1983 |
| JP | 58176454 | | 10/1983 |
| JP | 58222957 | | 12/1983 |
| JP | 59063350 | | 4/1984 |
| JP | 59096463 | | 6/1984 |
| JP | S59126958 | | 7/1984 |
| JP | 59039955 | | 9/1984 |
| JP | 59192853 | | 11/1984 |
| JP | 60222547 | | 11/1985 |
| JP | 62267571 | | 11/1987 |
| JP | 62288354 | | 12/1987 |
| JP | 62288355 | | 12/1987 |
| JP | 63243430 | | 10/1988 |
| JP | 1237346 | | 9/1989 |
| JP | 2211366 | | 8/1990 |
| JP | 2002089370 | | 3/2002 |
| JP | 4116256 | | 7/2008 |
| JP | 2009013965 | | 1/2009 |
| RU | 2192557 | | 11/2002 |
| WO | 12002888 | | 1/2012 |
| WO | 12009944 | | 1/2012 |
| WO | 2013111587 | | 8/2013 |

OTHER PUBLICATIONS

International Search Report and Written Opinion for PCT/US2014/051135 dated Jan. 22, 2015.

* cited by examiner

| T1 (°F) | Starting Position |
|---|---|
| 0 | 2% |
| 10 | 2% |
| 30 | 2% |
| 50 | 7% |
| 70 | 15% |
| 90 | 22% |
| 110 | 29% |

| Key |
|---|
| Data Set 1 |
| Data Set 2 |
| Common to Data Sets 1 & 2 |

| T1 (F) | Starting Position |
|---|---|
| 0 | 2% |
| 10 | 2% |
| 30 | 2% |
| 50 | 7% |
| 70 | 15% |
| 90 | 22% |
| 110 | 29% |

FIG. 8

| | | T1 - T2 (F) | | | | | | | | | | | |
|---|---|---|---|---|---|---|---|---|---|---|---|---|---|
| T1 (F) | Initial Ramp LS (sec) | 0 | 5 | 10 | 15 | 20 | 25 | 30 | 35 | 40 | 45 | 50 | Final Ramp LS (sec) |
| 0 | .25 | 65 | 64.9 | 64.8 | 64.7 | 64.6 | 64.5 | 64.4 | 64.3 | 64.2 | 64.1 | 54 | .2375 |
| 10 | .25 | 55 | 54.9 | 54.8 | 64.7 | 54.6 | 54.5 | 54.4 | 54.3 | 54.2 | 54.1 | 54 | .2125 |
| 30 | .25 | 55 | 54.9 | 54.8 | 54.7 | 54.6 | 54.5 | 54.4 | 54.3 | 54.2 | 54.1 | 54 | .0625 |
| 50 | .375 | 25 | 24.9 | 24.8 | 24.7 | 24.6 | 24.5 | 24.4 | 24.3 | 24.2 | 24.1 | 24 | 5.1125 |
| 70 | .375 | 25 | 24.9 | 24.8 | 24.7 | 24.6 | 24.5 | 24.4 | 24.3 | 24.2 | 24.1 | 24 | .0625 |
| 90 | .300 | 10 | 9.9 | 9.8 | 9.7 | 9.6 | 9.5 | 9.4 | 9.3 | 9.2 | 9.1 | 9 | .0625 |
| 110 | .300 | 4 | 3.9 | 3.8 | 3.7 | 3.6 | 3.5 | 3.4 | 3.3 | 3.2 | 3.1 | 3 | .0625 |
| | | Intermediate ramp LS (sec) | | | | | | | | | | | |

FIG. 9

| | | T1 - T2 (F) | | | | | | | | | | | |
|---|---|---|---|---|---|---|---|---|---|---|---|---|---|
| T1 (F) | Initial Ramp HS (sec) | 0 | 5 | 10 | 15 | 20 | 25 | 30 | 35 | 40 | 45 | 50 | Final Ramp HS (sec) |
| 0 | .425 | 65 | 64.9 | 64.8 | 64.7 | 64.6 | 64.5 | 64.4 | 64.3 | 64.2 | 64.1 | 54 | .0625 |
| 10 | .400 | 55 | 54.9 | 54.8 | 54.7 | 54.6 | 54.5 | 54.4 | 54.3 | 54.2 | 54.1 | 54 | .0625 |
| 30 | .475 | 45 | 44.9 | 44.8 | 44.7 | 44.6 | 44.5 | 44.4 | 44.3 | 44.2 | 44.1 | 44 | 9.8375 |
| 50 | .425 | 30 | 29.9 | 29.8 | 29.7 | 29.6 | 29.5 | 29.4 | 29.3 | 29.2 | 29.1 | 29 | .0625 |
| 70 | .375 | 20 | 19.9 | 19.8 | 19.7 | 19.6 | 19.5 | 19.4 | 19.3 | 19.2 | 19.1 | 19 | 5.0625 |
| 90 | .300 | 10 | 9.9 | 9.8 | 9.7 | 9.6 | 9.5 | 9.4 | 9.3 | 9.2 | 9.1 | 9 | .0625 |
| 110 | .300 | 4 | 3.9 | 3.8 | 3.7 | 3.6 | 3.5 | 3.4 | 3.3 | 3.2 | 3.1 | 3 | .0625 |
| | | Intermediate ramp HS (sec) | | | | | | | | | | | |

FIG. 10

| Key |
|---|
| Data Set 3 |
| Data Set 4 |

| T1 (F) | Starting Position |
|---|---|
| 0 | 2% |
| 10 | 2% |
| 30 | 2% |
| 50 | 7% |
| 70 | 15% |
| 90 | 22% |
| 110 | 29% |

FIG. 13

| | | T1 - T2 (F) | | | | | | | | | | | |
|---|---|---|---|---|---|---|---|---|---|---|---|---|---|
| T1 (F) | Initial Ramp LS (sec) | 0 | 5 | 10 | 15 | 20 | 25 | 30 | 35 | 40 | 45 | 50 | Final Ramp LS (sec) |
| 0 | .25 | 65 | 64.9 | 64.8 | 64.7 | 64.6 | 64.5 | 64.4 | 64.3 | 64.2 | 64.1 | 54 | .2375 |
| 10 | .25 | 55 | 54.9 | 54.8 | 64.7 | 54.6 | 54.5 | 54.4 | 54.3 | 54.2 | 54.1 | 54 | .2125 |
| 30 | .25 | 55 | 54.9 | 54.8 | 54.7 | 54.6 | 54.5 | 54.4 | 54.3 | 54.2 | 54.1 | 54 | .0625 |
| 50 | .375 | 25 | 24.9 | 24.8 | 24.7 | 24.6 | 24.5 | 24.4 | 24.3 | 24.2 | 24.1 | 24 | 5.1125 |
| 70 | .375 | 25 | 24.9 | 24.8 | 24.7 | 24.6 | 24.5 | 24.4 | 24.3 | 24.2 | 24.1 | 24 | .0625 |
| 90 | .300 | 10 | 9.9 | 9.8 | 9.7 | 9.6 | 9.5 | 9.4 | 9.3 | 9.2 | 9.1 | 9 | .0625 |
| 110 | .300 | 4 | 3.9 | 3.8 | 3.7 | 3.6 | 3.5 | 3.4 | 3.3 | 3.2 | 3.1 | 3 | .0625 |
| | | Intermediate ramp LS (sec) | | | | | | | | | | | |

FIG. 14

INTEGRATED IGNITION AND ELECTRONIC AUTO-CHOKE MODULE FOR AN INTERNAL COMBUSTION ENGINE

CROSS-REFERNCE TO RELATED PATENT APPLICATIONS

The present application is a continuation of U.S. patent application Ser. No. 14/460,095, filed Aug. 14, 2014, which claims the benefit of U.S. Provisional Patent Application Ser. No. 61/866,485, filed Aug. 15, 2013, the entireties of which are incorporated herein by reference.

FIELD

The present invention relates generally to systems and methods for controlling fuel-to-air ratio for an internal combustion engine, and specifically to modules, systems, and methods for electronically controlling fuel-to-air ratio for the internal combustion engine by electronically controlling the position of a choke valve in a carburetor.

BACKGROUND

Electronically controlled carburetors have been developed in order to improve engine starting and performance characteristics, such as when the engine is being idled. In such known control systems, the fuel-to-air ratio of the fuel mixture that is introduced to the combustion chamber is adjusted by controlling the setting of a choke valve within the carburetor. The setting of the choke valve is determined by taking into consideration certain variables, such as engine speed, intake air pressure, and engine coolant temperature. However, the consideration of the aforementioned variables in determining the setting of the choke valve has been found to be less than optimal.

Additionally, in known systems for controlling the fuel-to-air ratio of the fuel mixture, the control systems are created as stand-alone and/or separate modules relative to the engine and its other modules and/or sub-systems. As a result, the existing electronic control systems may add additional costs, take up valuable space within the engine compartment, and create an added degree of complexity in designing and/or building the engine.

In view of the above, a need exists for improved systems and methods for electronically controlling the fuel-to-air ratio for internal combustion engines.

SUMMARY

The present invention relates to systems and methods for electronically controlling the fuel-to-air ratio of the fuel mixture supplied to internal combustion engines and, in other instances, internal combustion engines incorporating the same.

According to an aspect of the present disclosure, a method of controlling a choke valve of an internal combustion engine using an electronic system is disclosed that comprises, in operable cooperation, a controller, a first temperature sensor configured to measure a first temperature indicative of engine temperature, a second temperature sensor configured to measure a second temperature indicative of ambient air temperature, and an actuator configured to move the choke valve, the method comprising: a) determining, with the controller, a starting position for the choke valve that is dependent on the first temperature; b) performing a first choke opening stage that comprises moving, with the actuator, the choke valve from an initial position to the starting position; c) determining, with the controller, a first ramp for opening the choke valve, wherein a first characteristic of the first ramp is dependent on the first and second temperatures; and d) subsequent to completion of the first choke opening stage, performing a second choke opening stage that comprises moving, with the actuator, the choke valve toward a fully-open position in accordance with the first ramp.

According to yet another aspect of the present disclosure, a method of controlling a choke valve of an internal combustion engine is disclosed using an electronic system comprising, in operable cooperation, a controller, a first temperature sensor configured to measure a first temperature indicative of engine temperature, a second temperature sensor configured to measure a second temperature indicative of ambient air temperature, and an actuator configured to move the choke valve, the method comprising: a) determining, with the controller, a first ramp for opening the choke valve, wherein a first characteristic of the first ramp is dependent on the first temperature and a difference between the first temperature and the second temperature; and b) performing a choke opening stage that comprises moving, with the actuator, the choke valve in accordance with the first ramp toward a fully-open position using the actuator.

According to still another aspect of the present disclosure, an electronic system for controlling a choke valve of an internal combustion engine is disclosed, the electronic system comprising: a first temperature sensor configured to measure a first temperature indicative of an engine temperature; a second temperature sensor configured to measure a second temperature indicative of an ambient air temperature; an actuator operably coupled to the choke valve to adjust position of the choke valve to adjust a fuel-to-air ratio of a fuel mixture to be combusted in the internal combustion engine; and a controller operably coupled to the actuator, the first temperature sensor, and the second temperature sensor, the controller configured to: (1) determine a starting position for the choke valve based on the first temperature, and operate the actuator to move the choke valve from an initial position to the starting position during a first choke opening stage; and (2) determine a first ramp having a characteristic that is dependent on the first and second temperatures, and operate the actuator to move the choke valve toward a fully-open position during a second choke opening stage in accordance with the first ramp.

In a yet further aspect of the present disclosure, an integrated ignition and electronic auto-choke module is disclosed. In one such aspect of the present disclosure, the integrated ignition and electronic auto-choke module comprises: a housing configured to be mounted to an engine block of an internal combustion engine adjacent a flywheel; the housing at least partially containing: a first temperature sensor for measuring a first temperature indicative of an engine temperature; a controller operably coupled to the first temperature sensor, the controller configured to: determine a starting position of a choke valve based on the first temperature; and operate an actuator to move the choke valve into the starting position during a first choke opening stage; and an ignition circuit.

In a still further aspect of the present disclosure, a method of controlling a choke valve of an internal combustion engine is disclosed using an electronic system that comprises, in operable cooperation, a controller, a feedback sensor configured to measure a parameter indicative of an air-to-fuel ratio of an air-fuel mixture to be or being combusted in the internal combustion engine, and an actuator configured to move the choke valve, the method comprising: a) the controller repetitively receiving signals from the feedback sensor that are indicative of the measured parameter during movement of the choke valve from a starting position toward a fully-open position; b) determining, with the controller, a rate at which the choke valve is to be moved toward the fully-open position based a most-recently received signal from the feedback sensor; c) moving, with the actuator, the choke valve toward the fully-open position at the rate most-recently determined during step b); and d) looping to step a) until it is determined, with the controller, that the choke valve is in the fully-open position.

In an even further aspect of the present disclosure, a method of controlling a choke valve of an internal combustion engine is disclosed using an electronic system that comprises, in operable cooperation, a controller, a feedback sensor configured to measure a parameter indicative of an air-to-fuel ratio of an air-fuel mixture to be or being combusted in the internal combustion engine, and an actuator configured to move the choke valve, the method comprising: a) performing a dynamic choke opening stage that comprises moving, with the actuator, the choke valve from a starting position toward a fully-open position based on measurements taken by the feedback sensor in accordance with a feedback loop formed between the choke valve and the feedback sensor.

In even another aspect of the present disclosure, an electronic system for controlling a choke valve of an internal combustion engine is disclosed, the electronic system comprising: a feedback sensor configured to measure a parameter indicative of whether an air-fuel mixture to be or being combusted in the internal combustion engine is at an optimal air-to-fuel ratio; an actuator operably coupled to the choke valve to adjust position of the choke valve to adjust the fuel-to-air ratio of the fuel mixture; and a controller operably coupled to the actuator and the feedback sensor to form a feedback loop, the controller configured to move the choke valve from a starting position to a fully-open position based on measurements taken by the feedback sensor.

In yet another aspect of the present disclosure, an internal combustion engine is disclosed comprising: an engine block; a combustion chamber that receives a fuel mixture; a choke valve for adjusting a fuel-to-air ratio of the fuel mixture received by the combustion chamber; and an integrated ignition and electronic auto-choke module comprising a housing configured to be mounted to the engine block, the housing at least partially containing: a first temperature sensor for measuring temperature of the engine block as a first temperature; a controller operably coupled to the first temperature sensor, the controller configured to: determine a starting position of the choke valve based on the first temperature; and operate an actuator to move the choke valve into the starting position during a first choke opening stage; and an ignition circuit.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 8 is a relational data table utilized by the controller to determine the starting position of the choke valve;

FIG. 9 is a relational data table utilized by the controller to determine the initial ramp, the intermediate ramp, and the final ramp for a low speed protocol;

FIG. 10 is a relational data table utilized by the controller to determine the initial ramp, the intermediate ramp, and the final ramp for a high speed protocol;

FIG. 13 is a relational data table utilized by the controller to determine the starting position of the choke valve;

FIG. 14 is a relational data table utilized by the controller to determine the initial ramp, the intermediate ramp, and the final ramp for a low speed protocol;

DETAILED DESCRIPTION OF THE DRAWINGS

Figure 1:
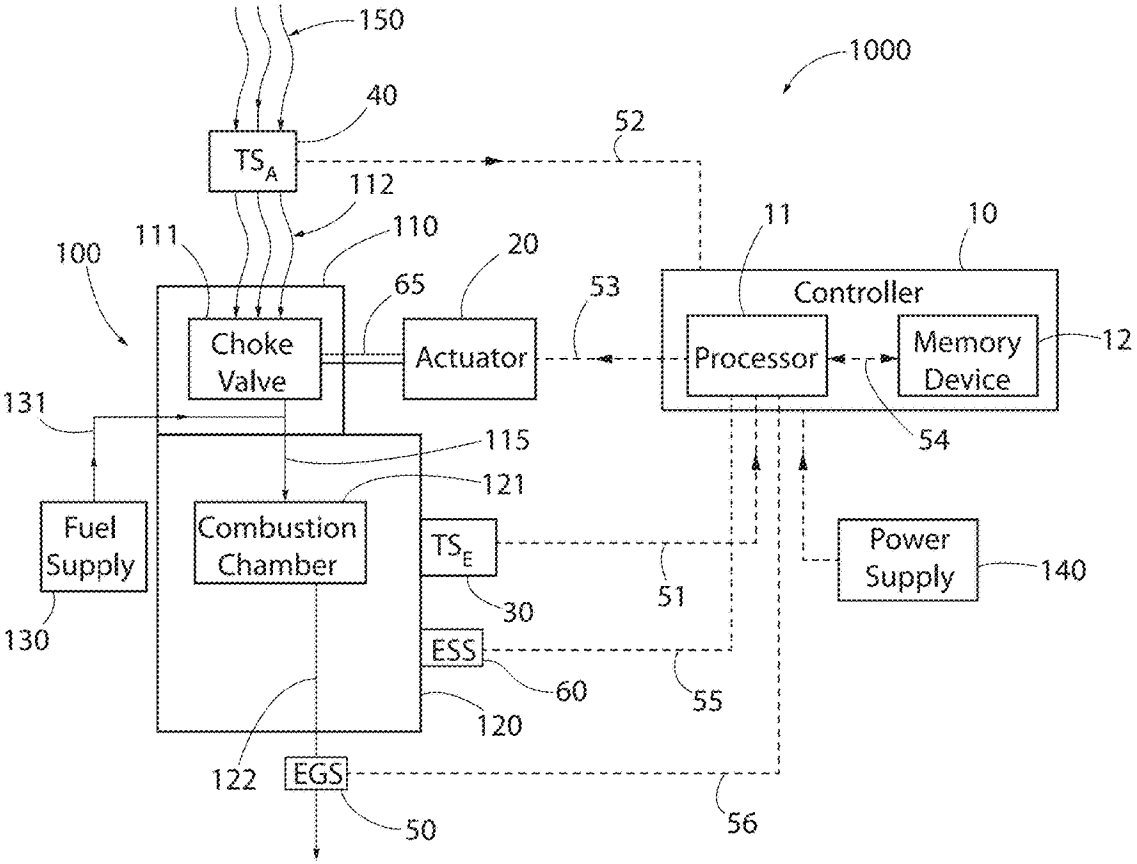
FIG. 1 is a schematic of an electronic auto-choke system in accordance with the present invention.

The following description of embodiment(s) of the invention is merely exemplary in nature and is in no way intended to limit the invention, its application, or uses. The description of illustrative embodiments according to principles of the present invention is intended to be read in connection with the accompanying drawings, which are to be considered part of the entire written description. In the description of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top," "bottom," "front" and "rear" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "secured" and similar refer to a relationship wherein structures are secured or attached to one another either directly or indirectly through intervening structures, as well as both movable or rigid attachments or relationships, unless expressly described otherwise. Moreover, the features and benefits of the invention are described by reference to the examples illustrated herein. Accordingly, the invention expressly should not be limited to such examples, even if indicated as being preferred. The discussion herein describes and illustrates some possible non-limiting combinations of features that may exist alone or in other combinations of features.

Referring first to FIG. 1, an electronic auto-choke system 1000 according to the present invention is illustrated. As exemplified, the electronic auto-choke system 1000 generally comprises a controller 10, an actuator 20, a first temperature sensor 30, a second temperature 40, and an engine speed sensor 60. As discussed below, an exhaust gas sensor 50 (or other sensors, such as an air-to-fuel ratio sensor) may be included in the electronic auto-choke system 1000 in certain aspects of the invention to gather additional or alternative inputs that can be utilized to control position and movement of the choke valve.

The controller 10, the actuator 20, the first temperature sensor 30, the second temperature 40, and the engine speed sensor 60 may be in operable cooperation with one another via electrical connection/communication pathways 51-55, which are schematically represented by dashed lines. Depending on the needs of the specific electronic auto-choke system 1000, the electrical connection/communication pathways 51-55 can comprise, without limitation, electrical wires, fiber-optics, communication cables, wireless communication paths, or combinations thereof. The exact structural nature and arrangement of the electrical connection/communication pathways 51-55 is not limiting of the present invention, so long as each of the electrical connection/communication pathways 51-55 can facilitate the desired operation, transmission, communication, powering, and/or control between the coupled elements/components, as described in greater detail below.

As shown in FIG. 1, the electronic auto-choke system 1000 is operably coupled to an internal combustion engine 100 in accordance with the present invention. As illustrated, the internal combustion engine 100 generally comprises a carburetor 110 and an engine block 120. A fuel supply 130 is operably coupled to the internal combustion engine 100 (specifically to the carburetor 110) in accordance with known techniques. The electronic auto-choke system 1000 is operably coupled to a power supply 140, such as a battery, alternator or other energy storage device, in accordance with known techniques. The internal combustion engine 100, of course, comprises and is supplemented by many other sub-systems and elements/components. Such details are omitted herein for ease of discussion with the understanding that such details are not necessary for the understanding of the present invention.

The controller 10 comprises a processor 11 and a memory device 12. While the processor 11 and memory device 12 are exemplified as separate components, the memory device 12 may be integrated with the processor 11 if desired. Moreover, while only one processor 11 and one memory device 12 are exemplified, the controller 10 may comprise multiple processors 11 and multiplier memory devices 12.

The processor 11 may be any computer central processing unit (CPU), microprocessor, micro-controller, computational device, or circuit configured for executing some or all of the processes described herein, including without limitation: (1) the retrieval and execution of the choke valve relational data tables: (2) the receipt, interpretation and usage of the temperature signals generated by the first and second temperature sensors 30, 40 as determining variables for the relational data tables; (3) the receipt, interpretation and usage of the engine speed signals generated by the engine speed sensor 60 in determining whether an engine cranking speed and/or engine starting speed has been reached, along with determining whether a low speed or high speed protocol should be used; and (4) the generation and transmission of the control signals that operate the actuator 20 to move the choke valve 111 to the desired position and at the desired rate.

The memory device 12 may include, without limitation, any suitable volatile or non-volatile memory including random access memory (RAM) and various types thereof, read-only memory (ROM) and various types thereof, USB flash memory, and magnetic or optical data storage devices (e.g. internal/external hard disks, floppy discs, magnetic tape CD-ROM, DVD-ROM, optical disk, ZIPTM drive, Blu-ray disk, and others), which may be written to and/or read by the processor 11 which is operably connected thereto. The memory device 12 may store the relational data tables (described in greater detail below) or other algorithms and/or calculations that can be used (by the processor 11) to determine the desired position of the choke valve 111and/or the rate at which the choke valve 111 is moved. As discussed in greater detail below, the temperatures measured by each of the first and second temperature sensors 30, 40, along with the engine speed measured by the engine speed sensor 60, may be used as input variables to establish optimal positions of the choke valve 111 during a choke opening event and/or the rate at which the choke valve 111 moves between said optimal positions.

While the determination of the optimal positions of the choke valve 111 and the optimal rates at which the choke valve 111 moves between said optimal positions will be described herein in terms of using a relational data table, the invention is not so limited in all aspects. For example, choke valve positioning and rate of movement calculations may take many forms, including without limitation, one or more algorithms, one or more relational data tables, or combinations thereof.

The controller 10 is operably coupled to the actuator 20. The actuator 20, in turn, is operably coupled to the choke valve 111. The controller 10 can operate the actuator 20 in a desired manner by generating and transmitting control signals. For example, the controller 10 may generate control signals based on the determinations made during carrying out of the method discussed herein (such as the four pulse sets shown in FIGS. 17-19, discussed below). In response to the control signals resulting from execution of the methods described herein, the actuator 20 is appropriately activated, thereby adjusting/moving the choke valve 111 to a desired position that corresponds to that which has been determined by the controller 10. In response to these control signals, the actuator 20 is appropriately activated, thereby adjusting position of the choke valve 111 and the rate at which the choke valve 111 moves.

The choke valve 111 can be adjusted between a fully-closed position, a fully-open position, and any incremental and/or continuous positional setting between the fully-closed and fully-open position. One such position is a starting position that may be determined to be an optimal position for achieving start-up of the engine from an engine off state. The actuator 20 is operably coupled to the choke valve 111 via a mechanical linkage 65. Mechanical linkages can take the form of any mechanical connection between the choke valve 111 and the actuator 20 such that when the actuator 20 operates/moves, there is a related and determined movement of the choke valve 111, which may be a choke plate of the carburetor 110. Mechanical linkages can comprise rods with ball and socket joints, linkage bars connected between the choke plate, and coupling of the end of the actuator shaft through a clevis. However, non-mechanical linkages are envisioned, such as electromagnetic and/or thermal couplings. When a mechanical linkage 65 is utilized, it is to be understood that the mechanical linkage 65 can take on a wide variety of linkage elements and arrangements thereof, none of which should be considered limiting of the present invention.

The choke valve 111, in certain structural arrangements, can be a butterfly valve as is common in the art of carburetors. In such an arrangement, the position of a choke plate is controlled by rotating the choke plate about a choke axis (which may be generally perpendicular to the direction of air flow) so that the choke plate assumes different angular positions within an air passageway of the carburetor 110. At each different angular position, the choke plate obstructs a different percentage of the transverse area of the air passageway of the carburetor 110. As a result, the flow characteristics of the ambient air flow 112 therethrough is altered. Because fuel is introduced into this ambient air flow stream 112 via the fuel supply line 131, the fuel-to-air ratio of the fuel mixture that is created within the carburetor 110 (and ultimately supplied to the combustion chamber 121 via the fuel mixture line 115) is varied by the choke plate position.

While the choke valve 111 is exemplified as a butterfly valve comprising a choke plate, the choke valve 111 is not limited to a choke plate structure in all aspects of the invention. The choke valve 111 can be any type of device that can be manipulated to various positions (i.e., settings) that ultimately varies the fuel-to-air ratio of the fuel mixture that is provided to the combustion chamber 121. For example, and without limitation, the choke valve 111 can take the form of a gate valve, a globe valve, a pinch valve, a diaphragm valve, a needle valve, a plug valve, a ball valve, a control valve, or combinations thereof.

In one aspect, the actuator 20 may comprise a stepper motor. The stepper motor may divide the rotation required to adjust the choke valve 111 from the fully-closed position to the fully-open position into a number of equal increments such that fine adjustment of the setting of the choke valve 111 can be achieved. The stepper motor's position can be commanded by the controller 110 to move and hold at any one of these increments. In certain arrangements, a motor driver circuit 160 (see FIG. 24) may be included as part of the electronic auto-choke system 1000 and operably coupled between the controller 10 and the actuator 20. In instances where the actuator 20 is a bipolar stepper motor, the motor driver circuit 160 may be used to control and drive the current in one winding of the bipolar stepper motor and comprise a compatible logic input, a current sensor, a monostable and an output stage with built-in protection diodes. In certain other arrangements, the motor driver circuit may be omitted or built into the stepper motor itself. The motor driver circuit 160 may also comprise a separate internal timer that determines the driver rate. Additional controls for micro-stepping or half-stepping the actuator 20 may also be included if the design requires such a specialized control.

In certain examples set forth herein, the actuator 20 is a stepper motor wherein motor movement is divided into equal increments of four motor steps. Four full steps of the unipolar stepper motor can also be seen as one full revolution of the motor. Motor movement in both directions will be referred to as revolutions. In one such example, a stepper motor is utilized in which 55 revolutions are carried out to move the choke valve 111 from the fully-closed position to the fully-open position.

While a stepper motor is exemplified as a suitable actuator 20, the actuator 20 may be any device or assembly that can convert the control signal that is generated by the controller 10 into physical manipulation of the choke valve 111 to adjust the setting thereof. For example, in other arrangements, the actuator 20 may take the form of electric actuators, electromagnetic actuators, piezoelectric actuators, pneumatic actuators, hydraulic pistons, relays, comb drives, thermal bimorphs, digital micromirror devices and electroactive polymers. Such electric actuators may include a solenoid.

The first temperature sensor 30 of the electronic auto-choke system 1000 is positioned to measure a first temperature that is indicative of the temperature of the internal combustion engine 100. As exemplified, the first temperature sensor 30 may be mounted to the engine block 120 to measure the temperature of the engine block 120 itself as the first temperature. As used herein, the term engine block is broadly used to include the engine crankcase 123, the cylinder blocks 124, and the cylinder heads 125 (see FIG. 21). Alternatively, the first temperature sensor 30 may be mounted to another structure sufficiently adjacent to (or in thermal cooperation with) the engine block 120 such that a reliable temperature measurement thereof can be obtained. In still other systems, the first temperature sensor 30 may be mounted to or adjacent another component of the engine 100, and may measure the temperature at or adjacent that component.

Figure 21:
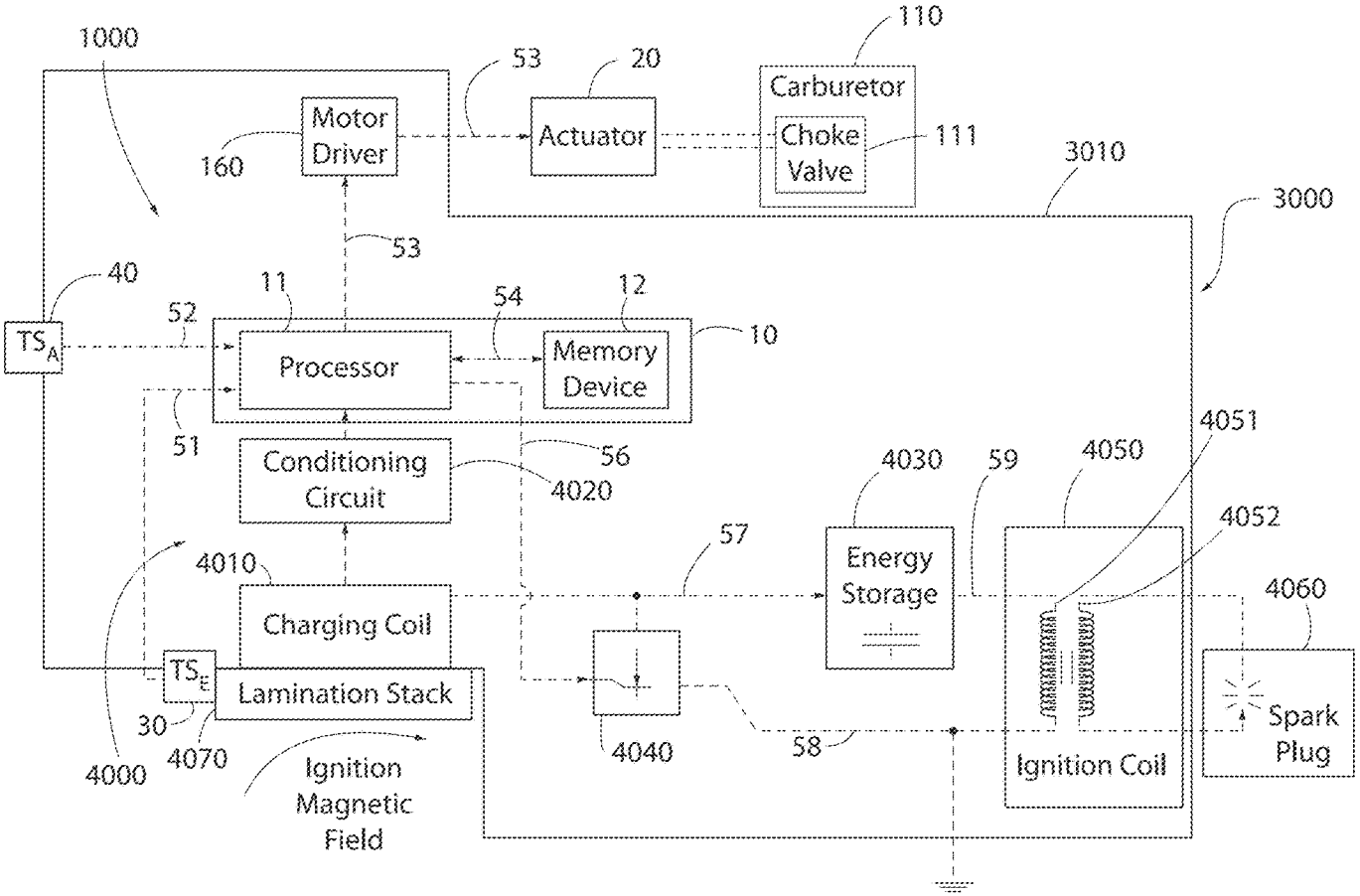
FIG. 21 is a schematic of an integrated ignition and electronic auto-choke module in accordance with the present invention.

In one specific arrangement, the first temperature sensor 30 may be mounted to the engine crankcase 123 itself at a position adjacent a flywheel 126 of the internal combustion engine 100 (see FIG. 21). In other arrangements, the first temperature sensor 30 may be mounted at alternate locations on the engine block 120 or may be mounted adjacent the engine block 120 and in contact therewith. In other arrangements, the first temperature sensor 30 may be in contact with a component in thermal cooperation with the engine block 120 that can provide a thermal reading that corresponds to the temperature of the engine block 120 in a determinable manner. In one exemplary arrangement discussed in greater detail below, the first temperature sensor 30 is mounted to the lamination stack 4070 of an ignition module 3000, which in turn is mounted to the engine crankcase 123 and, thus, is in thermal cooperation therewith.

As mentioned above, the first temperature sensor 30 may measure the engine temperature and outputs a first temperature signal that is indicative of the engine temperature. This first temperature signal is transmitted to the controller 10 via the electrical connection/communication pathway 51 where it is utilized by the controller to determine starting position of the choke valve 111 and/or a rate at which the choke valve 111 is to be opened, as discussed in greater detail below). The first temperature sensor 30 can repetitively or continuously measure the first temperature so that the controller 10 is automatically provided with first temperature signals that are indicative of the engine temperature. Alternatively, the first temperature sensor 30 can periodically measure the engine temperature at predetermined temporal periods, predetermined engine events, and/or predetermined engine conditions so that the controller 10 is provided with first temperature signals that are indicative of the engine temperature only at certain desired times, engine events, engine conditions, or upon prompting.

The first temperature sensor 30 may be an electrical temperature sensor. For example, the first temperature sensor 30 may comprise one or more thermistors. In other arrangements, the first temperature sensor 30 may comprise one or more thermocouples, resistance thermometers, silicon bandgap temperature sensors, thermostats, RTD' s and/or state change temperature sensors.

The second temperature sensor 40 of the electronic auto-choke system 1000 may be positioned to measure a second temperature that is indicative of the temperature of the ambient air 150. As exemplified, the ambient air 150 in which the second temperature sensor 40 is positioned to measure the temperature of is eventually drawn into the carburetor 110 where it is used to create the fuel mixture that is delivered to the combustion chamber 121 via fuel mixture line 115. The second temperature sensor 40 may, however, be positioned at other locations that are exposed to the ambient air 150 that is not drawn into the carburetor. For example, the second temperature sensor 40 may be positioned near a blower intake in an air-cooled engine arrangement (see FIG. 6) or at any position that is subjected to the ambient air 150. In still other systems, the second temperature sensor 40 may be positioned to measure other temperatures, such as a separate engine component temperature or air (such as intake, exhaust, or cooling air) temperature.

The second temperature sensor 40 measures the ambient air temperature and outputs a second temperature signal that is indicative of the ambient air temperature. This second temperature signal is transmitted to the controller 10 via the electrical connection/communication pathway 52 where it is utilized by the controller 10 to determine a rate at which the choke valve 111 is to be opened, as discussed in greater detail below). In other arrangements, the second temperature signal may also be utilized by the controller 10 to determine the starting position of the choke valve 111 (in combination with the first temperature signal).

The second temperature sensor 40 can repetitively or continuously measure the second temperature so that the controller 10 is automatically provided with second temperature signals that are indicative of the ambient air temperature. Alternatively, the second temperature sensor 40 can periodically measure the second temperature at predetermined temporal periods, predetermined engine events, and/or predetermined engine conditions so that the controller 10 is provided with second temperature signals that are indicative of the ambient air temperature only at certain desired times, engine events, engine conditions, or upon prompting.

The second temperature sensor 40 may be an electrical temperature sensor. For example, the second temperature sensor 40 may comprise one or more thermistors. In other arrangements, the second temperature sensor 40 may comprise one or more thermocouples, resistance thermometers, and/or silicon bandgap temperature sensors. In certain arrangements of the invention, the second temperature sensor 40 may be omitted if ambient air temperature does not play a role in the determination of the optimization of choke valve positioning and/or rate of movement of the choke valve.

The electronic auto-choke system 1000 further comprises an engine speed sensor 60. The engine speed sensor 60 is configured to measure the rotational speed of the internal combustion engine. The engine speed sensor 60 is operably coupled to the controller 10 via the electrical pathway 55, as described above. The engine speed sensor 60 measures the engine speed of the internal combustion engine and relays this information to the controller 10 so that the controller can utilize the measured engine speed in determining optimal positioning of the choke valve 111 and/or rate(s) at which the choke valve 111 is opened, as discussed in greater detail below. In one arrangement (see FIG. 21), the engine speed sensor 60 may comprise a charging coil that can be considered a rotation sensor that, in response to a magnet on the flywheel, generates an electric charge due to a magnetic path being formed in a lamination stack. In other arrangements, such as when a magneto ignition system is not used, a rotation sensor may be provided that is a component other than and/or in addition to the charging coil that can detect rotation of the engine through mechanical, electrical or magnetic detection, potentially through proper coupling to a crankshaft or a camshaft.

The engine speed sensor 60 can repetitively or continuously measure the engine speed so that the controller 10 is automatically provided with engine speed measurements. Alternatively, the engine speed sensor 60 can periodically measure the engine speed at predetermined temporal periods, predetermined engine events, and/or predetermined engine conditions so that the controller 10 is provided with engine speed measurements only at certain desired times, engine events, engine conditions, or upon prompting.

The electronic auto-choke control system 1000, in certain arrangements, may also include additional sensors so that other variables can be taken into consideration in determining the optimal positioning of the choke valve 111 and/or the optimal rate at which the choke valve 111 is opened. For example, the electronic auto-choke control system 1000 can be configured to measure air-to-fuel ratios in the carburetor, engine load, and/or exhaust gas characteristic and take it into consideration in determining the optimal scheme for controlling the choke valve 111 opening. This can be accomplished by providing sensors or other mechanisms for measuring the desired parameter and/or condition and providing the measured parameter and/or condition to the controller 10. The determination of the position and rate of opening of the choke valve 111, in such arrangements, is modified in an appropriate manner to include the additional parameter and/or condition as a variable in determining the control scheme of the choke valve 111.

In one such arrangement, an exhaust gas sensor 50 can be provided that measures an exhaust gas characteristic that is transmitted to the controller 10 for consideration in determining the optimized control scheme of the choke valve 111 during engine startup and/or shutdown.

The exhaust gas sensor 50 is operably coupled to an exhaust line 122 of the combustion chamber 121. The exhaust gas sensor 50 measures a desired characteristic of the exhaust gas. The exhaust gas sensor 50 can, for example, be a concentration sensor that measures the concentration of a particular compound or gas in the exhaust gas stream, such as an oxygen concentration sensor.

The exhaust gas sensor 50 generates and transmits a signal indicative of the measured exhaust gas characteristic to the controller 10 for processing via the electrical connection/communication pathway 56. To this end, a modified version of the relational data tables (or other calculations or algorithms) are stored in the memory device 12 that include the measured exhaust gas characteristic as a variable, in addition to the measured engine temperature, ambient air temperature, and/or engine speed. The processor 11 retrieves the modified versions of the relational data tables from the memory device 12 and determines the optimal control scheme for the choke valve 111 using the modified versions of the relational data tables. As will be discussed in greater detail, in one aspect of the invention, the exhaust gas sensor 50 (or other sensor that is configured to measure a parameter indicative of the air-to-fuel ratio to be or being combusted in the combustion chamber) can be operably coupled to the controller 10 to form a closed feedback loop in which the rate and/or position of the choke valve 111 is dynamically controlled during the second choke opening stages COS2 in response to measurements taken by such a feedback sensor, which may be in substantially real-time.

Referring now to FIGS. 2A-C and 3 concurrently, a method 200 of electronically controlling the choke valve 111 according to the present invention using the electronic auto-choke system 1000 will be described. As will be discussed in greater detail below, the method of controlling the choke valve 11 is exemplified as taking place during an engine startup procedure in which the choke valve 111 is moved from an initial position to a fully-open position. The choke valve opening process can generally be divided into two stages, namely a first choke opening stage COS1 and a second choke opening stage COS2. The first choke opening stage COS1 includes moving the choke valve 111 from the initial position to the starting position (or to one of the reduced starting positions, discussed below with respect to FIGS.6-7) while the second choke opening stage COS2 includes moving the choke valve 111 from the starting position (or one of the reduced starting positions) to the fully-open position. As exemplified, the first choke opening stage COS2 comprises opening the choke valve 111 in accordance with a starting ramp SR while the second choke opening stage COS2 comprises opening the choke valve 111 in accordance with an initial ramp IR, an intermediate ramp MR, and a final ramp FR. In some variations, one or more of the ramps may be combined or omitted.

At decision step 201, the controller 10 determines whether a "key on" condition has been detected. At this stage, the choke valve 111 is in an initial position (see FIG. 3). As exemplified, the initial position is a partially-open position (i.e., not a fully-closed position), which is exemplified in FIG. 3 as being 2% open. The initial position can, of course, take on other values and in certain instances may be a fully-closed position if desired. However, establishing the initial position as a partially-open position may have advantages in that the possibility of the choke valve 111 freezing shut in cold conditions is minimized and/or eliminated.

A "key on" condition can be detected by the controller 10 when an ignition circuit is completed, which can be accomplished, for example, by the turning of the key or the actuation of another operator-manipulated device. If a "key on" condition is not detected, the electronic auto-choke system 1000 remains in a sleep or off mode and the method returns to START. If a "key on" condition is detected, the method proceeds to process step 202.

At process step 202, the first temperature sensor 30 measures the engine temperature as a first temperature T1 while the second temperature sensor 40 measures the ambient air temperature as a second temperature T2. The controller 10 may prompt the first and second temperature sensors 30, 40 to take the temperature measurements. Once the measurements are taken, the first and second temperatures T1, T2 are then transmitted to the controller 10 for processing, thereby completing process step 202. At process step 203, the controller 10 receives: (1) the first temperature T1 that is indicative of the engine temperature from the first temperature sensor 30; and (2) the second temperature T2 that is indicative of the ambient air temperature from the second temperature sensor 40. Upon receiving the first and second temperature signals $T_1$, $T_2$, the processor 11 of the controller 10 retrieves, from the memory device 12, a starting position relational data table that is used to determine the starting position of the choke valve 111, which is based at least on the measured first temperature T1.

Figures 4, 5:
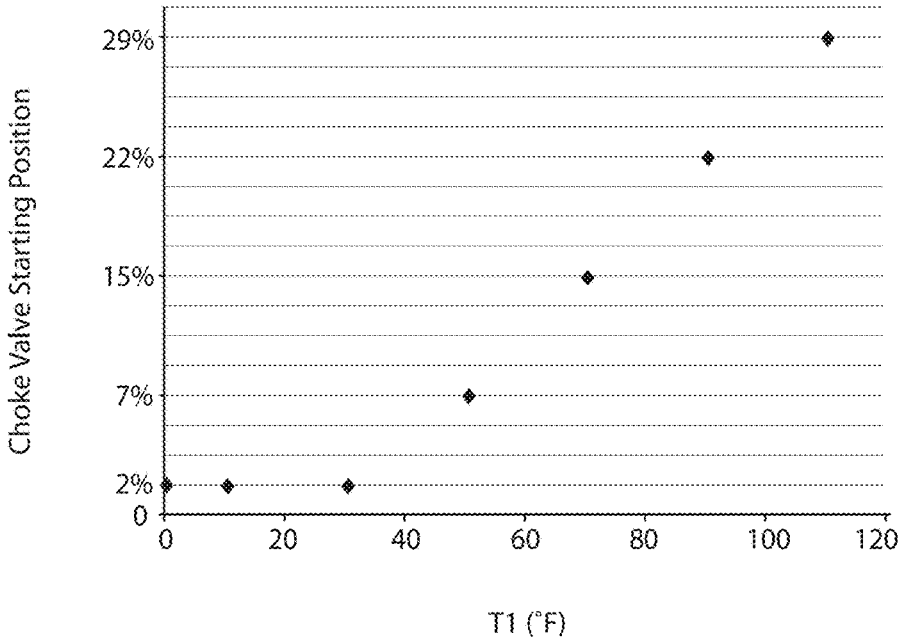
FIG. 4 is a relational data table utilized by the controller to determine the starting position of the choke valve based on measured engine temperature.
FIG. 5 is a graph showing the choke valve in different starting positions in accordance with the relational data table of FIG. 4.

An example of a starting position relational data table that can be used by the controller 10 to determine the starting position of the choke valve 111 is shown in FIG. 4 (graphically illustrated in FIG. 5). The values of the starting position relational data table can be established through experimentation and/or calibration so that the starting position of the choke valve 111 is selected for the measured first temperature T1 (i.e., the measured engine temperature) that achieves an optimal air-to-fuel ratio of the mixture being supplied to the combustion chamber 121. Optimization of the air-to-fuel ration of the mixture may include reduced emissions, improved engine starting, reduced stalling, improved fuel efficiency, or combinations thereof. As can be seen in FIG. 4, when the first temperature T1 is measured to be 50° F. (or measured to be at a number that is rounded off to 50° F.), the controller 10 determines that the starting position of the choke valve 111 is to be set at 7% open, thereby completing process step 203.

While the determination of the starting position is independent of the second temperature T2 in the exemplified method, the starting position may be based on both the first and second temperatures T1, T2 in other arrangements of the invention. For example, in one such alternate arrangement, the starting position may be based on both the first temperature T1 and the second temperature T2. In one specific example, the second temperature T2 may have an effect on the determination of the starting position of the choke valve 111 only when the difference (absolute) between the first and second temperatures T1, T2 is at or above a predetermined threshold.

Once step 203 is completed and the controller has determined the starting position of the choke valve 111, the controller 10 generates and transmits appropriate control signals (discussed in greater detail below with respect to FIGS. 18-20) to the actuator 20 via the electrical connection/communication pathway 53. Upon receipt of the control signals, the actuator 20 moves the choke valve 111 from the initial position (which is 2% open in the example of FIG. 3) to the starting position (which is 7% open in the example of FIG. 3), thereby completing process step 204. In opening the choke valve 111 from the initial position to the starting position, the controller 10, in one arrangement, will open the choke valve 111 at the fastest rate possible for the actuator 20 (see FIG. 18). Thus, as illustrated graphically in FIG. 3, the slope of the starting ramp SR is at a maximum that can be achieved by the actuator 20.

Once the choke valve 111 is in the starting position, the controller 10 continues to monitor the state of the internal combustion engine 100. Specifically, at process step 205, the speed of the engine is measured using the engine speed sensor 60 while the choke valve 111 is maintained in the starting position. The controller 10 receives/detects the measured engine speed, thereby completing process step 206. Upon receipt of the measured engine speed, the controller 10 determines whether the measured engine speed is at or above an engine cranking speed, thereby performing decision step 207. The engine cranking speed may be a predetermined speed that is stored in the memory device 12 and is indicative that the internal combustion engine 100 is cranking. For example, in one specific arrangement, the engine cranking speed may be set at 300 revolutions-per-minute (RPM). Of course, other numerical values can be used as the engine cranking speed. The exact numerical value used may depend on a variety of factors, including engine rating, etc.

Figure 3:
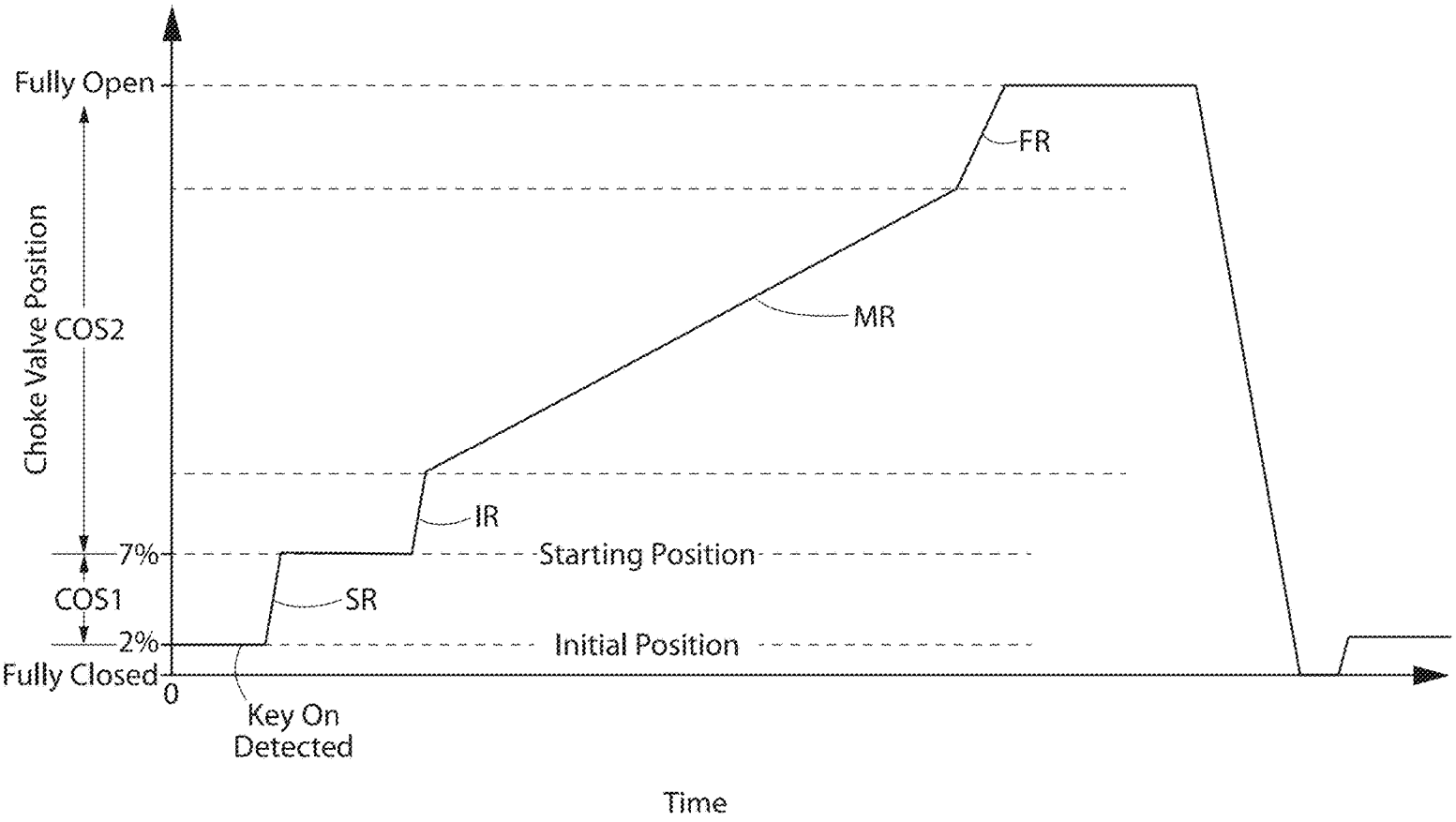
FIG. 3 is a line graph plotting choke valve position versus time during performance of the method of FIG. 2.

If, upon performing decision step 207, the controller 10 determines that the measured speed is not at or above (i.e., is below) the engine cranking speed, the controller 10 returns to process step 205. If, however, upon performing decision step 207, the controller 10 determines that the measured speed is at or above the engine cranking speed, the controller 10 proceeds to decision step 208 where the controller 10 receives a new engine speed measurement from the engine speed sensor 60 and evaluates the newly received engine speed measurement to determine whether a failed cranking event has occurred. In determining whether a failed cranking event has occurred, the controller 10 compares the newly received engine speed measurement to a predetermined engine speed that is stored in the memory device 12, which may be the engine cranking speed in certain instances. If in performing decision step 208, it is determined that a failed cranking event has not occurred, the controller 10 proceeds to decision step 209. FIG. 3 exemplifies a situation in which a failed cranking event has not been detected during the engine start-up procedure.

Figure 2A:
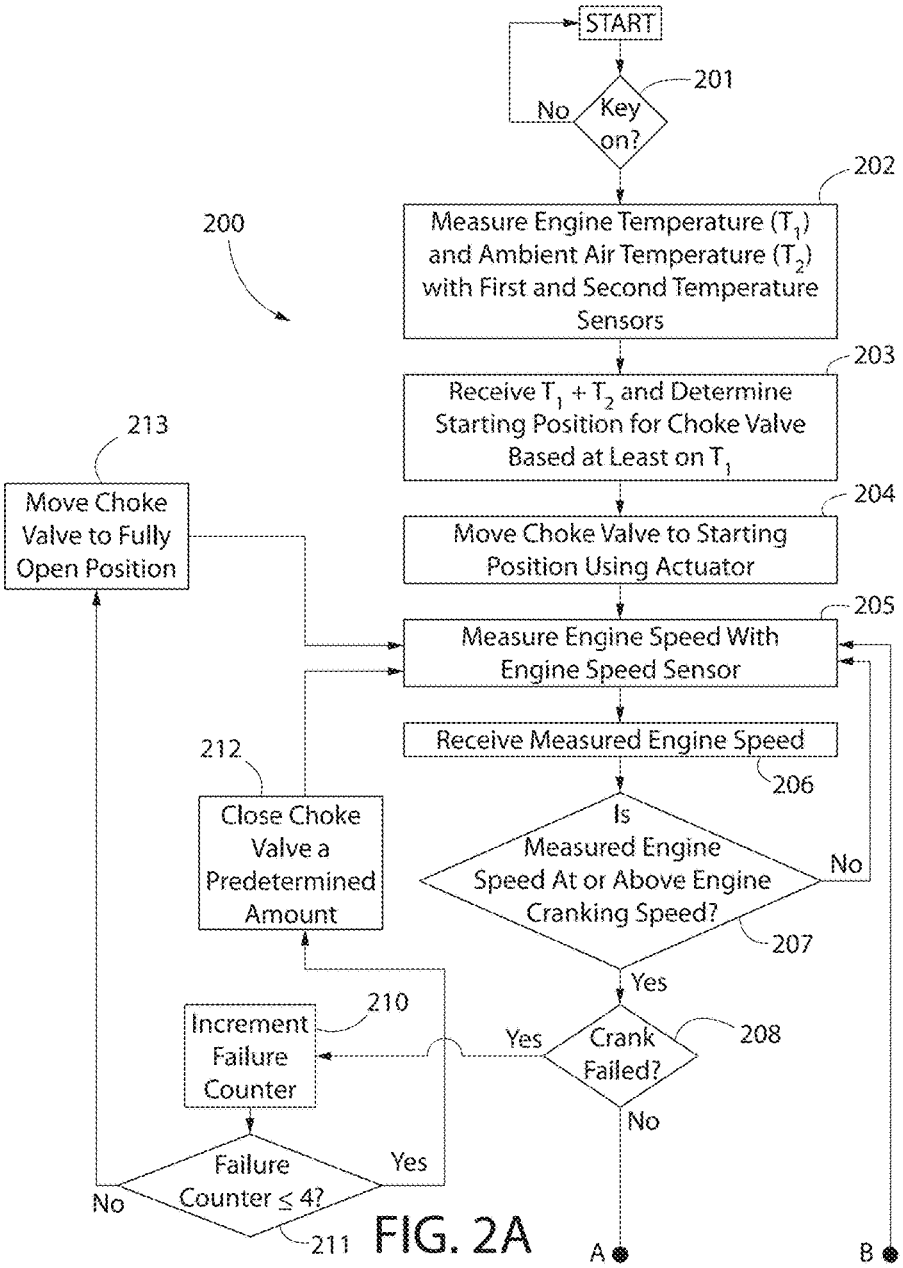
FIGS. 2A-2C illustrate a flowchart of a method of opening a choke valve carried out by the electronic auto-choke system of FIG. 1 in accordance with the present invention.
Figure 6:
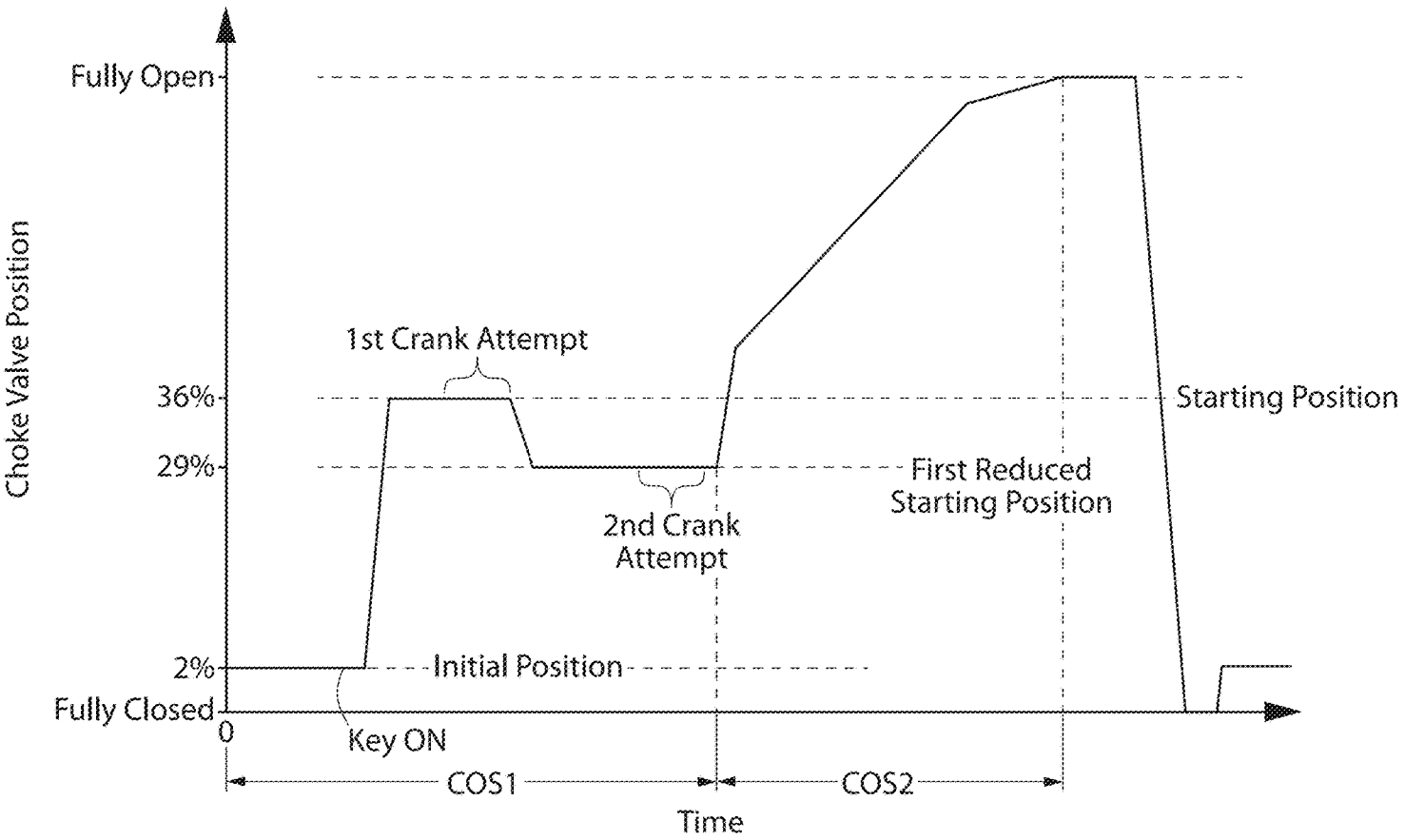
FIG. 6 is a line graph plotting choke valve position versus time during performance of the method of FIG. 2, wherein a single failed engine cranking event has been detected while the choke valve is in the starting position.
Figure 7:
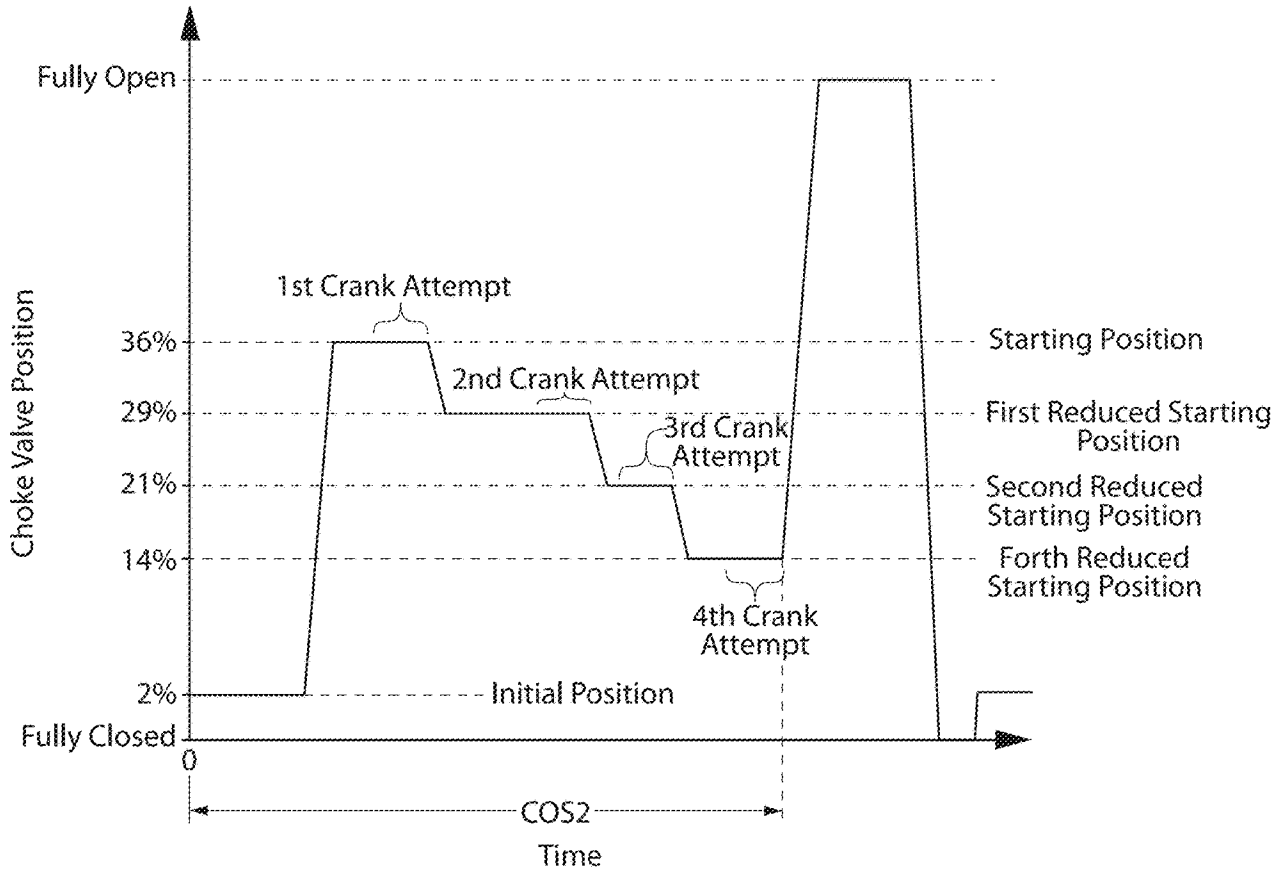
FIG. 7 is a line graph plotting choke valve position versus time during performance of the method of FIG. 2, wherein three consecutive failed engine cranking events have been detected while the choke valve is in the starting position and system is reset.

Referring now to FIGS. 2A and 6-7 concurrently, if in performing decision step 208, it is determined that a failed cranking event has occurred, the controller 10 proceeds to process step 210. At process step 210, the controller 210 increments (i.e., adds 1 to) a counter that is used to track the number of consecutive failed cranking events. Once process step 210 is complete, the controller 10 proceeds to decision step 211 where it analyzes the counter to determine whether the number of consecutive failed cranking events stored by the counter is less than or equal to a predetermined number. In the example, this number is set to four but can be set to other numbers if desired. If it is determined that the number of consecutive failed cranking events stored by the counter is less than the predetermined number, the controller 10 proceeds to process step 212.

At process step 212, the controller 10 closes the choke valve 111 a predetermined amount so that the choke valve 111 is moved from the starting position to a first reduced starting position, The controller 10 then returns to process step 205. By closing the choke valve 111 a predetermined amount (which in the exemplified embodiment is 7%), a more fuel-rich mixture of air and fuel is introduced into the combustion chamber 121. As shown in FIG. 6, a single failed cranking event was detected in this example and the choke valve 111 was closed to the first reduced starting position. Upon steps 205-208 being performed with the choke valve 111 in the first reduced starting position, the controller 10 has determined at decision step 208 that a failed cranking event has not been detected and the controller 10 moves to decision step 209, thereby beginning the second choke opening stage SOC2 (discussed in greater detail below). In the example of FIG. 6, the second choke opening stage SOC2 includes moving the choke valve 111 from the first reduced starting position to the fully-open position and the first choke opening stage SOC1 includes moving the choke valve 111 from the initial position to the starting position, and then from the starting position to the first reduced starting position.

Figure 17:
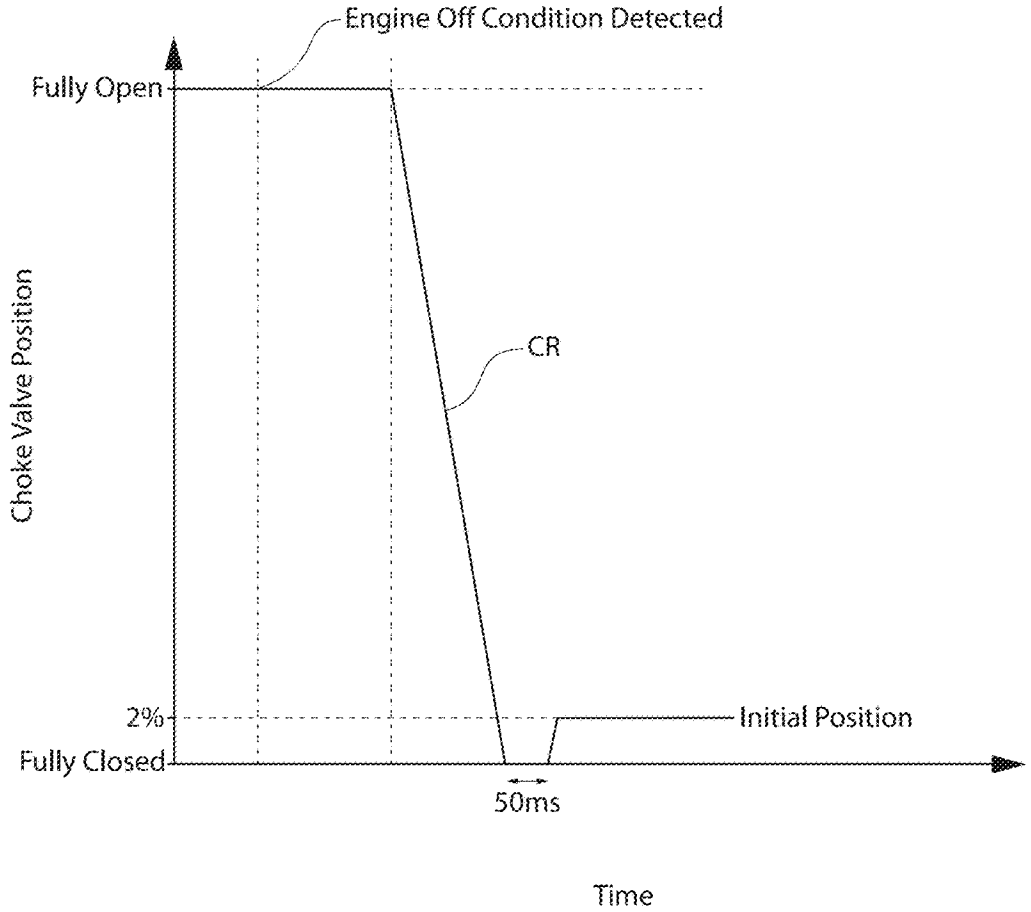
FIG. 17 is a line graph of choke valve position versus time during performance of the method of FIG. 2 upon an engine off condition being detected.

As shown in FIG. 7, it is possible that after the choke valve has moved to the first reduced starting position and the process returns to process step 205, additional consecutive failed cranking event can be detected at decision step 208. In such an event, steps 210-212 are carried out each time until it is determined at decision step 211 that the number of consecutive failed cranking events stored by the counter is not less than the predetermined number. However, each consecutive time a failed cranking event is detected at decision step 208, and it is subsequently determined at decision step 211 that the number of consecutive failed cranking events stored by the counter is less than the predetermined number, the controller 10 will continue to close the choke valve 111 an additional amount. As exemplified FIG. 7, the second time this happens, the position of the choke valve 111 is moved from the first reduced starting position to the second reduced starting position. The third time this happens, the position of the choke valve 111 is moved from the second reduced starting position to the third reduced starting position. However, the fourth time this happens, the position of the choke valve 111 is moved from the third reduced starting position to the fourth reduced starting position, but it is then determined at the decision step 211 that the number of consecutive failed cranking events stored by the counter is not less than the predetermined number. As a result of this determination, the controller 10 proceeds to process step 213 and the controller moves the choke to the fully-open position. Upon return to step 205, the controller 10 is essentially waiting for a "key off" signal as it is trapped in a perpetual loop. Upon detecting a "key off" signal, the system is reset (as shown in FIG. 17) and the method 200 starts again. As exemplified in FIG. 7, the predetermined amount that the controller 10 closes the choke valve 111 is the same between consecutively detected cranking failures (which is 7% in the example). However, the predetermined amount may not be the same in other arrangements but, rather, may vary between consecutive failed cranking events. It certain instances, as used herein, the term "starting position" may include the "reduced starting positions" discussed above.

Returning now to FIGS. 2A-C and 3, at decision step 214 the controller 10 determines whether the measured engine speed is at or above an engine running speed. The engine running speed may be a predetermined speed that is stored in the memory device 12. The engine running speed may be indicative that the internal combustion engine 100 is at an acceptable idle speed in certain arrangements. For example, in one specific arrangement, the engine running speed may be set at 800 RPM. Of course, other numerical values can be used as the engine running speed. The exact numerical value used may depend on a variety of factors, including engine rating, etc.

If the controller 10 determines during decision step 214 that the measured engine speed is below the engine running speed, the controller 10 returns to process step 205. If, however, the controller 10 determines during decision step 214 that the measured engine speed is at or above the engine running speed, the controller 10 continues to process step 215. At process step 215, the engine speeds sensor 60 re-measures the engine speed after a predetermined time delay (such as 500 ms). The engine speed sensor 60 then transmits the re-measured engine speed to the controller 10 for evaluation. The controller 10 receives the re-measured engine speed and determines whether the re-measured speed is at or above an engine speed threshold, which may be a predetermined empirical value stored in the memory device 12, thereby completing decision step 215.

If it is determined by the controller 10 at decision step 215 that the re-measured engine speed is below the engine speed threshold, the controller 10 proceeds to process step 216. At process step 216, the controller 10 retrieves and utilizes a low speed protocol that is stored in the memory device 12 to determine the characteristics of the second choke opening stage COS2, which includes opening the choke valve 111 in accordance with the initial ramp IR, the intermediate ramp MR, and the final ramp FR, the details of which are determined from a low speed relational data table. An exemplary low speed relational data table is shown in FIG. 9, which will be described in greater detail below. Once the initial ramp IR, the intermediate ramp MR, and the final ramp FR for the choke valve 111 are determined in process step 216 for the low speed protocol, the controller 10 opens the choke valve 111 using the actuator 20 in accordance with the initial ramp IR, the intermediate ramp MR, and the final ramp FR that were determined using the low speed relational data table, thereby completing process step 217. Once process step 217 is complete, the controller 10 proceeds to decision step 218.

If, however, it is determined at decision step 215 by the controller 10 that the re-measured engine speed is at or above the engine speed threshold, the controller 10 proceeds to process step 219. At process step 219, the controller 10 retrieves and utilizes a high speed protocol that is stored in the memory device 12 to determine the characteristics of the second choke opening stage COS2, which includes opening the choke valve 111 in accordance with the initial ramp IR, the intermediate ramp MR, and the final ramp FR, the details of which are determined from a high speed relational data table. An exemplary high speed relational data table is shown in FIG. 10, which will be described in greater detail below. Once the initial ramp IR, the intermediate ramp MR, and the final ramp FR for the choke valve 111 are determined in process step 219 for the high speed protocol, the controller 10 opens the choke valve 111 using the actuator 20 in accordance with the initial ramp IR, the intermediate ramp MR, and the final ramp FR that were determined using the high speed relational data table, thereby completing process step 217. Once process step 217 is complete, the controller 10 proceeds to decision step 218.

In performing process steps 216 & 217 or process steps 219 & 217, which requires values for the measured first and second temperature T1, T2, the controller may utilize the first and second temperatures T1, T2 that were obtained at process steps 202-203. However, in certain arrangements, new measurements for the first and second temperatures T1, T2 may be obtained by the controller 10 from the first and second temperature sensors 30, 40 immediately prior to the performance of the steps 216 or 219 or during some other time when the choke valve 111 is in the starting position. Obtaining newly measured first and second temperatures T1, T2 may be desirable due to the fact that the engine temperature may change once the flywheel begins to spin. Moreover, the ambient air temperature may also be different if the new air within the blower housing (which was previously outside of the blower housing) is at a substantially different temperature than the air that was initially within the blower housing during the initial start-up measurement.

Figure 2B:
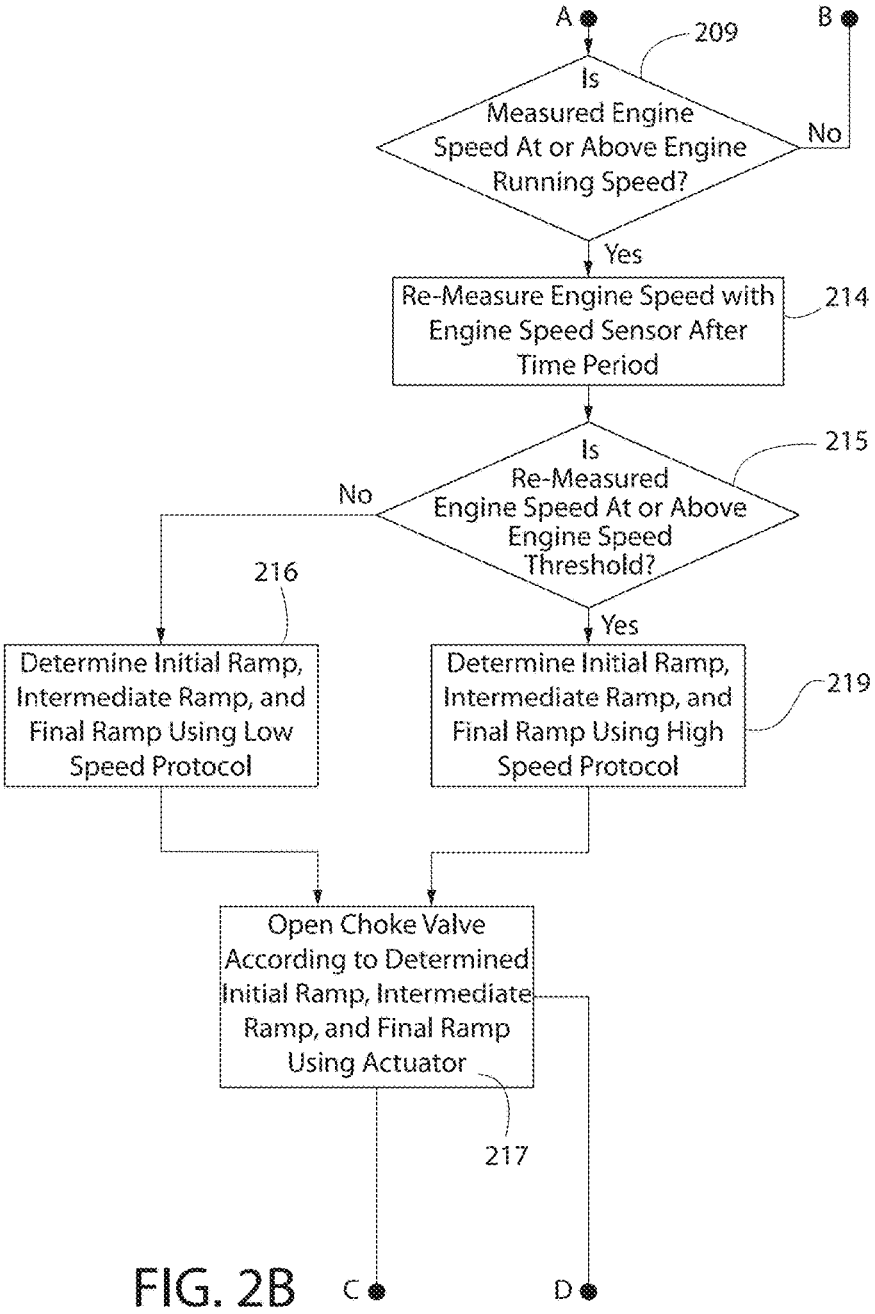

As can be seen from FIG. 2B, irrespective of whether the controller 10 determines the characteristics of the second choke opening stage COS2 using the low speed protocol (steps 216 & 217) or the high speed protocol (steps 219 & 217), the controller 10 arrives at process step 217, and then proceeds to decision step 218. At decision step 218, the controller 10 determines whether the choke valve 111 is in the fully-open position upon completion of the opening of the choke valve 111 in accordance with the determined initial ramp IR, intermediate ramp MR, and final ramp FR of the selected high or low speed protocol. If it is determined that the choke valve 111 is not fully-open, the controller 10 returns to process step 217 and continues to open the choke valve 111 in accordance with the selected high or low speed protocol as discussed above until the choke valve 111 reaches a fully-open position. If, however, it is determined that the choke valve 111 is fully-open at decision step 218, the controller proceeds to process step 222. At process step 222, movement of the choke valve 111 is ceased by stopping the actuator 20.

Upon completion of process step 222, the controller 10 moves to decision step 223 where the controller 10 monitors for an "engine off" condition while the engine continues to run with the choke valve 111 in the fully-open position. An "engine off" condition can take the form of the controller detecting a "key off" event (or other operator activated event that opens the ignition circuit) or detecting that the engine speed is at zero RPM. If the controller does not detect an "engine off" condition, the controller 10 continues to monitor for an "engine off" condition, thereby looping at decision step 223. If, however, the controller detects an "engine off" condition step decision step 223, the controller 10 proceeds to perform process steps 224-225 during a shut-down process that ultimately returns the choke valve 111 to the initial position.

Figure 2C:
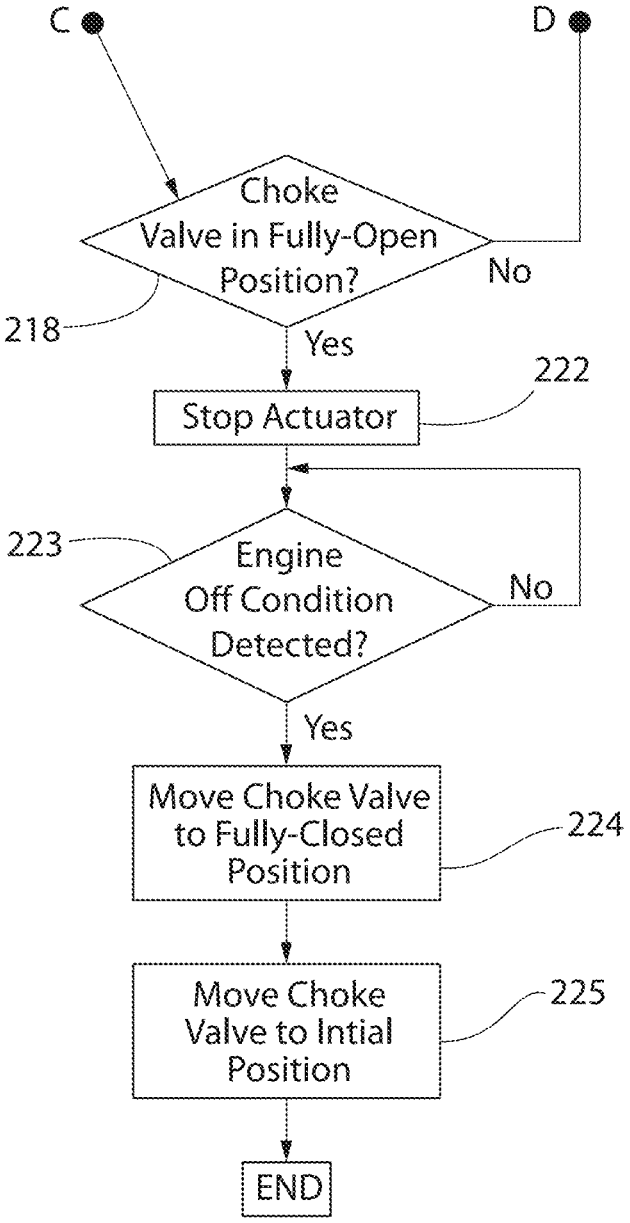

This shut-down process will now be described in relation to FIGS. 2C and 17. At process step 224 the controller moves the choke valve 111 from the fully-open position to the fully-closed position, thereby completing process step 224. The closing of the choke valve 111 is graphically illustrated in FIG. 17 as closing ramp CR. The rate of movement of the choke valve during the closing ramp (i.e., the negative slope) may be a maximum rate at which the actuator 20 can close the choke valve 111. After a time delay, the controller 10 then opens the choke valve 111 to the initial position, thereby completing process step 225. This movement may happen after the engine 100 is shut off, requiring power to be maintained at the controller 10 for this period. The initial position, as mentioned above, may be partially-open position, such as 2% open. This will prevent any possible concerns with the choke valve 111 freezing in the fully-closed, which may happen in embodiments where the choke valve 111 is a choke plate, which can freeze to the carburetor body. The system then shuts down and waits for another "key on" signal.

Figure 11:
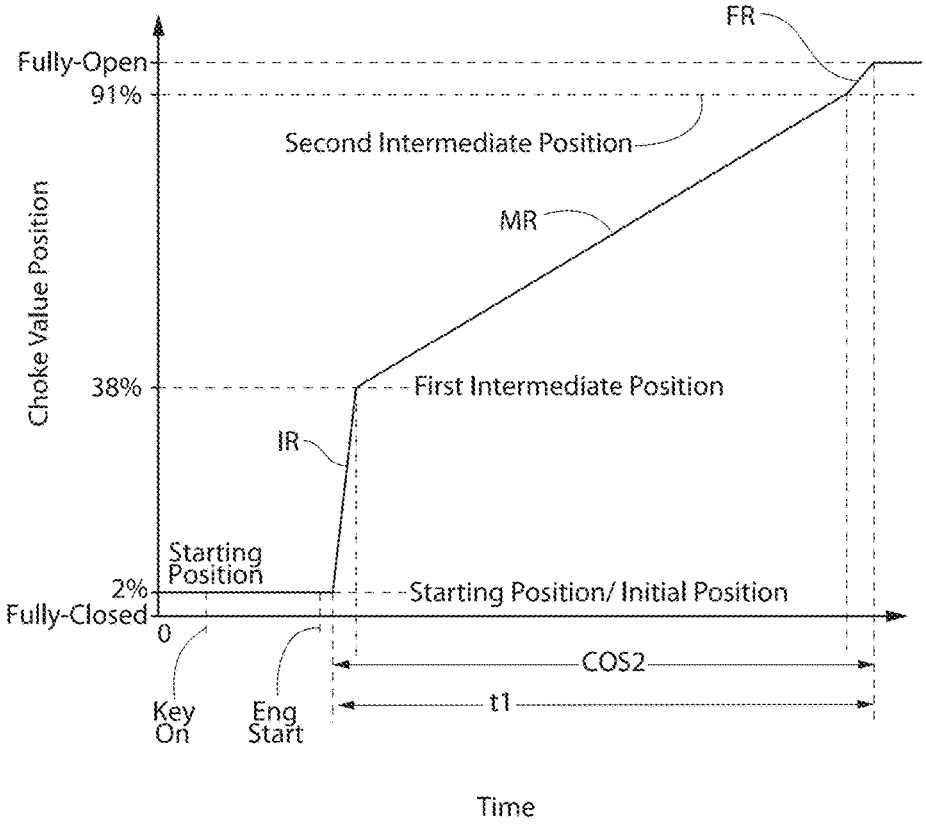
FIG. 11 is a line graph of choke valve position versus time during performance of the method of FIG. 2 based on the relational data tables of FIGS. 8-10, wherein a low speed protocol has been utilized for a cold engine start.

Referring now to FIGS. 8-9 and 11 concurrently, additional details of the second choke opening stage COS2, including details relating to the determination of the characteristics (such as duration and rate/slope) of the initial ramp, the intermediate ramp, and the final ramp that the choke valve 111 will follow during opening will now be discussed. The determination of the characteristics of the initial ramp, the intermediate ramp, and the final ramp will be described below in relation to the Data Set 1 of FIGS. 8-9 (see Key on FIG. 8), which is for choke valve control for the start-up of a "cold" engine in which the low speed protocol has been selected for the second choke opening stage COS2. It is to be understood, however, that the same principles are applicable to the determination of the characteristics of the initial ramp, the intermediate ramp, and the final ramp when the high speed protocol is utilized and/or when the start-up is for a "hot" engine.

As exemplified, the initial ramp IR extends from the starting position to a first intermediate position. The intermediate ramp MR extends from the first intermediate position to a second intermediate position. The final ramp FR extends from the second intermediate position to the fully-open position. Conceptually, the initial ramp IR can be considered a first choke opening sub-stage of the second choke opening stage COS2, the intermediate ramp MR can be considered a second choke opening sub-stage of the second choke opening stage COS2, and the final ramp FR can be considered a third choke opening sub-stage of the second choke opening stage COS2.

As can be seen in FIG. 8 (and as discussed above), the starting position of the choke valve 111 is determined based on the measured first temperature T1 (i.e., the measured engine temperature). In the example of the Data Set 1, the measured first temperature T1 is 10° F. and the measured second temperature T2 is 10° F. As can be seen from the relational data table of FIG. 8, for purposes of determining the starting position, the controller 10 may have to round the measured first temperature T1 to the closest value for which a reading is established in the relational data table. In this example, determination of the starting position is made independent of the second measured temperature T2. However, as mentioned above, in certain alternate arrangements, the second measured temperature T2 can have an effect on the determination of the starting position.

In the current example in which the measured first temperature T1 is 10° F., the controller 10 determines that the starting position of the choke valve 10 is 2% open. However, because the initial position is also set as 2% open, the controller 10 does not need to open the choke valve 111 to achieve the starting position (thereby omitting the starting ramp). Thus, in this instance, the initial position and the starting position are the same.

After the controller has determined that the low speed protocol is to be utilized (as discussed above), the controller 10 utilizes the relational data table of FIG. 9 to determine the initial ramp IR. For a measured first temperature of 10° F., the controller 10 determines that the initial ramp IR is to have a duration of 0.25 seconds. For the initial ramp IR, the controller 10 is configured to open the choke valve 111 at a predetermined rate (i.e., at a predetermined slope). The predetermine rate at which the choke valve 111 is moved during the initial ramp IR can be stored in the memory device 12 and retrieved by the controller 10. The rate at which the choke valve 111 is moved during the initial ramp IR is greater than the rate at which the choke valve 111 is moved during intermediate ramp MR. In the exemplified arrangement, the predetermined rate at which the choke valve 111 is moved during the initial ramp IR is the maximum rate at which the actuator 20 can be driven by the controller 111.

Because the rate at which the choke valve 111 is moved during the initial ramp IR is predetermined, and the starting position is already established, the determination of the duration of the initial ramp IR using the relational data table of FIG. 9 inherently establishes the first intermediate position of the choke valve 111, which in the example is 38% open. As such, the initial ramp IR is based on the measured first temperature T1. More specifically, in the exemplified arrangement, the duration of initial ramp is dependent on the first measured temperature T1 while the rate at which the choke valve 111 is opened during the initial ramp is independent of the first measured temperature T1.

Having established the characteristics of the initial ramp IR, the controller 10 then determines the characteristics of the intermediate ramp MR using the relational data table of FIG. 9. As can be seen from FIG. 9, the characteristics of the intermediate ramp MR are dependent on both the first measured temperature T1 and the second measured temperature T2. Specifically, the duration of the intermediate ramp MR is dependent on both the first measured temperature T1 and the second measured temperature T2. More specifically, the duration of the intermediate ramp MR has a first level dependency on the measured first temperature T1 and a second level dependency on the absolute difference between the measured first temperature T1 and the measured second temperature T2 (i.e., $|T1-T2|$). In the example, having a measured first temperature T1 of 10° F. and a measured second temperature T2 is 10° F. results in an absolute difference of 0° F. Thus, using the relational data table of FIG. 9, it is determined that the intermediate ramp MR is to have a duration of 55 seconds. Similar to the rate of the initial ramp IR, the second intermediate position (i.e., the end point of the intermediate ramp MR) is also predetermined and stored in the memory device 12. In the example, the second intermediate position is established at 91%. Thus, because the beginning and end positions (i.e., the first and second intermediate positions) of the intermediate ramp MR are already known/established, the controller's determination of the duration of the intermediate ramp MR from the relational data table of FIG. 9 inherently determines the rate at which the choke valve 111 is opened during the intermediate ramp MR (i.e., the slope of the intermediate ramp MR). While the second intermediate position is exemplified as being preset to 91% open, it is to be understood that other values can be used. Additionally, in certain arrangements, the second intermediate position may be set at the fully-open position such that the final ramp FR is eliminated. In such an instance, the second choke opening stage COS2 would consist of the initial and intermediate ramps IR, MR.

Having determined the characteristics of the initial and intermediate ramps IR, MR as discussed above, the controller 10 then utilizes the relational data table of FIG. 9 to determine the characteristics of the final ramp FR. As shown in FIG. 9, the characteristics of the final ramp FR are dependent on the measured first temperature T1. In the exemplified arrangement, the characteristics of the final ramp FR are independent of the measured second temperature T2 but may be dependent thereon in alternate arrangements.

As with the intermediate ramp MR, the duration of the final ramp FR is dependent on the first measured temperature T1 and can be determined using the relational data table of FIG. 9. For the example, the final ramp FR is determined to have a duration of 0.2125 ms for a measured first temperature T1 of 10° F.

Thus, because the beginning and end positions (i.e., the second and fully-open positions) of the final ramp FR are already known/established, the controller's determination of the duration of the final ramp FR from the relational data table of FIG. 9 inherently determines the rate at which the choke valve 111 is opened during the final ramp FR (i.e., the slope of the final ramp FR).

In the exemplified graphs of FIGS. 3, 11-12 and 15-16, the rates at which the choke valve 111 is opened during each of the starting ramp SR, the initial ramp IR, the intermediate ramp MR, and the final ramp FR are shown as a constant rate. Thus, the slope of each of the starting ramp SR, the initial ramp IR, the intermediate ramp MR, and the final ramp FR is shown to be linear. However, in certain other arrangements of the invention, the rate at which the choke valve 111 is opened during each of the starting ramp SR, the initial ramp IR, the intermediate ramp MR, and/or the final ramp FR can be a variable rate, such that the slope will be non-linear, including without limitation curved, stepped, etc. In fact, as will be discussed below with respect to FIGS. 18-20, while the rate at which the choke valve 111 is opened during each of the starting ramp SR, the initial ramp IR, the intermediate ramp MR, and the final ramp FR of FIGS. 3, 11-12 and 15-16 is illustrated as being constant rate, the rate is in fact a variable stepwise rate. Thus, what is shown in FIGS. 3, 11-12 and 15-16 is an effective rate at which the choke valve 111 is opened during each of the starting ramp SR, the initial ramp IR, the intermediate ramp MR, and the final ramp FR.

Figure 18:
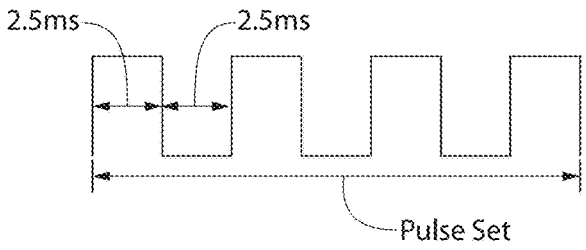
FIG. 18 is a graph of a four pulse signal set that is used to drive movement of the stepper motor for one full revolution, which in turn opens and closes the choke valve in a corresponding manner.
Figure 19:
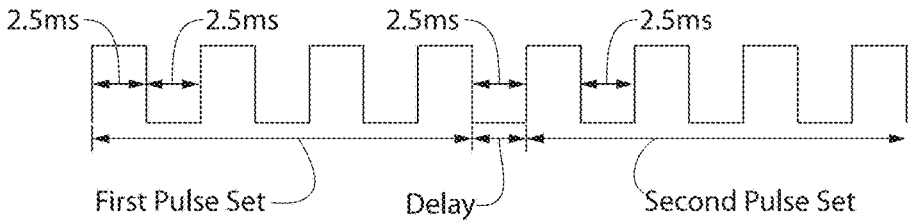
FIG. 19 is a graph of a two consecutive four pulse signal sets in which the delay between the four pulse sets is set equal to the delay between consecutive pulses in the four pulse sets, thereby achieving a first rate of opening the choke valve.
Figure 20:
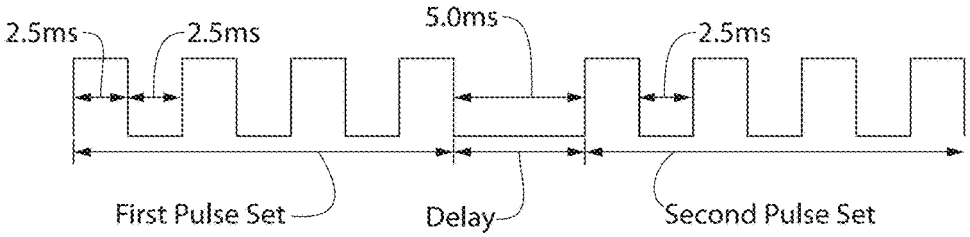
FIG. 20 is a graph of a two consecutive four pulse signal sets in which the delay between the four pulse sets is set greater than the delay between consecutive pulses in the four pulse sets, thereby achieving a second rate of opening the choke valve that is less than the first rate of FIG. 19.

Referring now to FIGS. 18-20 concurrently, the methodology by which the controller 10 drives movement of actuator 20, which in this case is a unipolar stepper motor, to open and close the choke valve 111 at various rates will be described. The movement of the stepper motor is divided into equal increments of four motor steps, wherein four motor steps achieves one full revolution of the stepper motor. For one specific example, the stepper motor is configured such that fifty-five revolutions (i.e., 220 motor steps) of the stepper motor is required to move the choke valve from the fully-closed position to the fully-open position. The controller 10 controls movement of the stepper motor (which in turn moves the choke valve in a corresponding manner) by generating pulses that are transmitted to the stepper motor, wherein each pulse move the stepper motor a single motor step. More specifically, as can be seen in FIG. 18, the controller is configured to generate a set of pulses. In the exemplified arrangement, the controller 10 generates a set of four pulses. The four pulse set was selected over a single pulse to keep the rotation calculation of the stepper motor simple and also to make sure the stepper motor didn't slip while changing directions. In the exemplified control logic, the pulse width that is transmitted to the stepper motor is kept at constant 2.5 ms, which is the fastest possible.

To change the rate at which the stepper motor opens or closes the choke valve 111, a delay between the sets of pulses is varied as desired. This is exemplified by comparing the pulse graphs of FIGS. 19 and 20. As shown in FIG. 19, the delay between the first and second pulse sets is set as small as possible (namely 2.5 ms). Thus, when the pulse set control of FIG. 19 is utilized, the choke valve 111 will be moved a first rate. In comparison, the delay between the first and second pulse sets is set larger in FIG. 20 (namely 5.0 ms). Thus, when the pulse set control of FIG. 20 is utilized, the choke valve 111 will be moved a second rate that is less than the first rate.

Figure 12:
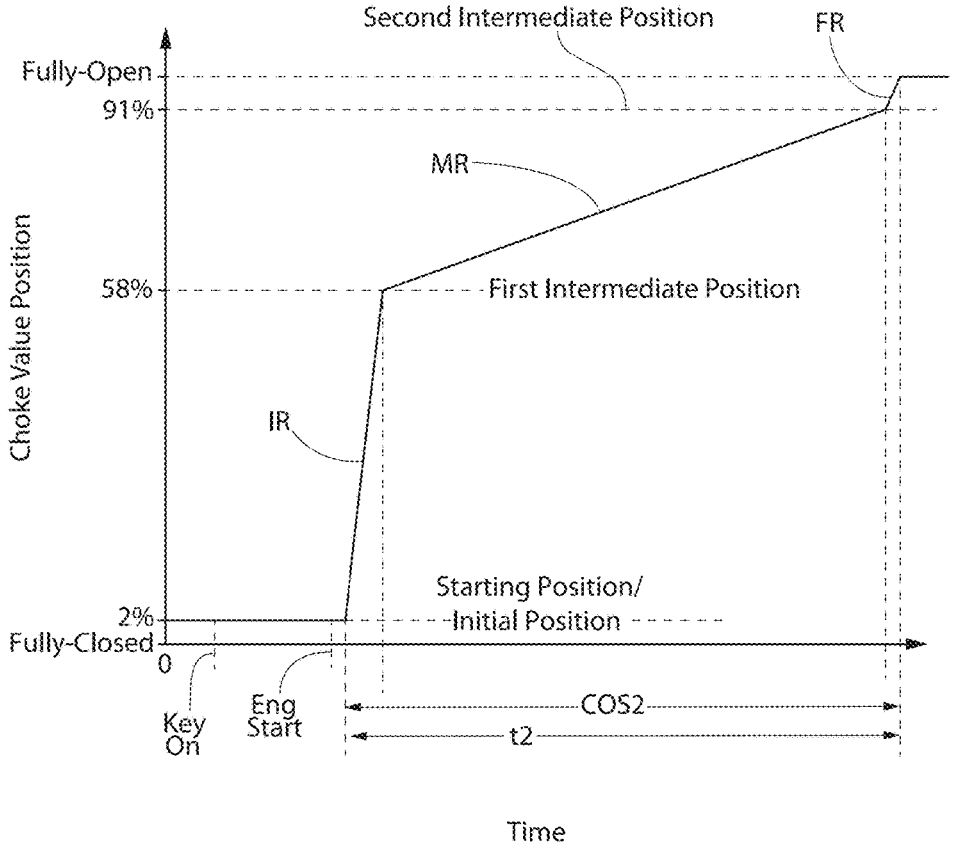
FIG. 12 is a line graph of choke valve position versus time during performance of the method of FIG. 2 based on the relational data tables of FIGS. 8-10, wherein a high speed protocol has been utilized for a cold engine start.

Referring now to FIGS. 8-12 concurrently, the effect of utilizing the low speed protocol versus utilizing the high speed protocol on the characteristics of second choke opening stage COS2 for the same measured first and second temperatures T1, T2 will be discussed. FIG. 11 is a graphical representation of choke valve movement using Data Set 1 while FIG. 12 is a graphical representation of choke valve movement using Data Set 2. As can be seen, for these examples, the measured first temperature is 10° F. and the measured second temperature is 10° F. for both Data Sets 1 and 2. Thus, for each of Data Sets 1 and 2, the starting position is determined to be the same (i.e., 2% open in the example).

However, for the remainder of Data Set 1 (which dictates the characteristics of second choke opening stage COS2 in FIG. 11), the values are obtained from the low speed protocol relational data table of FIG. 9. By comparison, for the remainder of Data Set 2 (which dictates the characteristics of second choke opening stage COS2 of FIG. 12), the values are obtained from the high speed protocol relational data table of FIG. 10.

It can be seen by comparing FIGS. 11 and 12 that the duration of the initial ramp IR is increased when the high speed protocol is used as compared to the low speed protocol. Thus, the duration of the initial ramp IR is dependent on the engine speed measured while the choke valve is in the starting position. However, the rate at which the choke valve 111 is opened during the initial ramp IR is the same for both the high and low speed protocols which, as discussed above can be pre-selected to be the fastest rate at which the actuator 20 can open the choke valve 111. Thus, the rate at which the choke valve 111 is opened during the initial ramp IR is independent of the engine speed measured while the choke valve is in the starting position.

Furthermore, by comparing FIGS. 11 and 12, it can further be seen that the duration of the intermediate ramp MR is independent of the engine speed measured while the choke valve 111 is in the starting position. However, it can be seen that the rate at which the choke valve 111 is opened during the intermediate ramp MR is dependent on the engine speed measured while the choke valve is in the starting position. Regarding the final ramp FR, it can be seen that both the duration and the rate at which the choke valve 111 is opened during the final ramp FR is dependent on the engine speed measured while the choke valve is in the starting position.

Finally, the second choke valve opening stage COS2 of FIG. 11 (i.e., the low speed protocol) takes a total time t1 to complete while the second choke valve opening stage COS2 of FIG. 12 (i.e., the high speed protocol) takes a total time t2 to complete. In certain arrangements, t1 may be equal to t2 such that the total time of the second choke valve opening stage COS2 is independent of engine speed measured while the choke valve 111 is in the starting position, when the first and second temperatures T1, T2 are the same.

Figure 15:
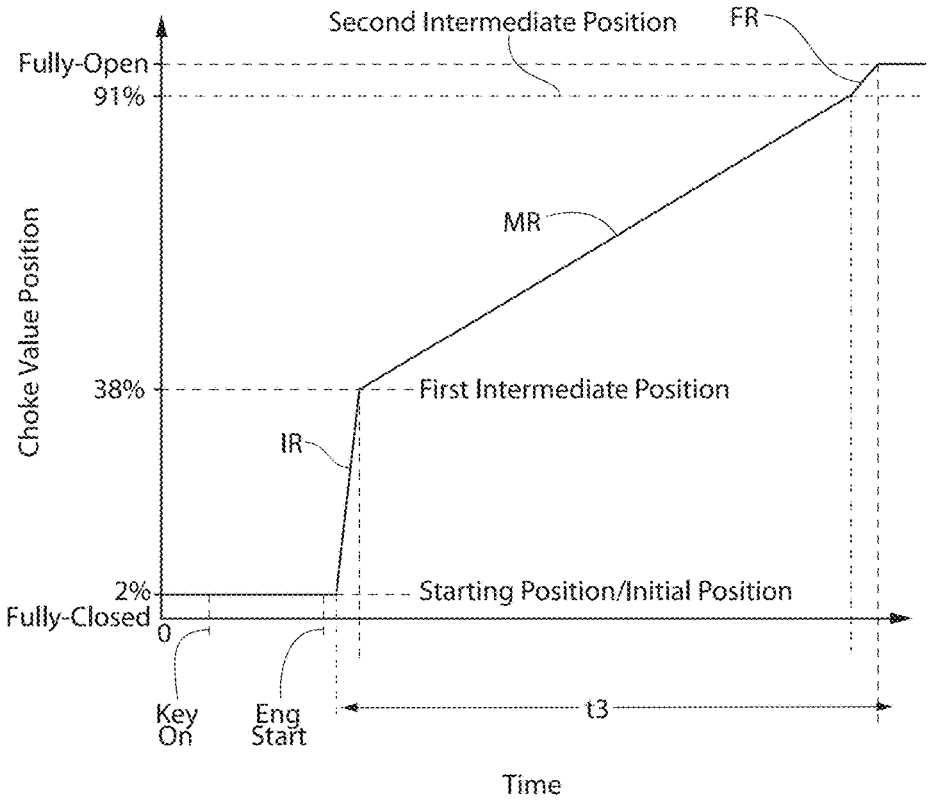
FIG. 15 is a line graph of choke valve position versus time during performance of the method of FIG. 2 based on the relational data tables of FIGS. 13-14, wherein the low speed protocol of FIG. 8 has been utilized for a cold engine start.
Figure 16:
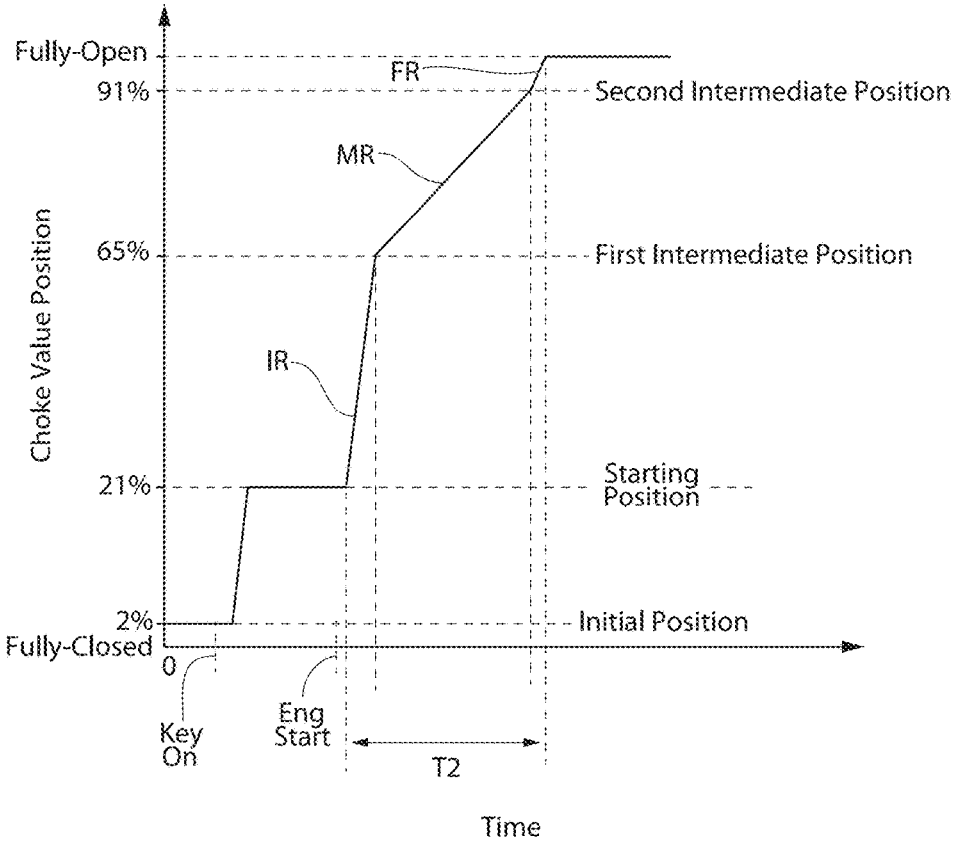
FIG. 16 is a line graph of choke valve position versus time during performance of the method of FIG. 2 based on the relational data tables of FIGS. 13-14, wherein the low speed protocol of FIG. 8 has been utilized for a hot engine start.

Referring now to FIGS. 13-16 concurrently, the effect of different first and second temperatures T1, T2 on the characteristics of the second choke opening stage COS2 for the same measured engine speed will be discussed. FIG. 15 is a graphical representation of choke valve movement using Data Set 3 while FIG. 16 is a graphical representation of choke valve movement using Data Set 4. As can be seen, for these examples, the measured first temperature is 10° F. and the measured second temperature is 10° F. for Data Set 3 (i.e., a cold engine start) while the measured first temperature is 90° F. and the measured second temperature is 80° F. for Data Set 4 (i.e., a hot engine start). A low speed protocol is assumed to have been selected by the controller for each of these scenarios. Thus, the low speed relational data table of FIG. 14 is utilized to determine the characteristics of the second choke opening stage COS2 for both the cold and hot engine start to generate the remaining values of Data Sets 3 and 4.

It can be seen by comparing FIGS. 15 and 16 that the staring positions are different and, thus, are dependent on the measured first temperature T1 as discussed above. Regarding the initial ramp IR, the duration of the initial ramp IR in FIG. 16 is greater that the duration of the initial ramp IR in FIG. 15. Thus, the duration of the initial ramp IR is dependent on the measured first temperature T1. However, the rate at which the choke valve 111 is opened during the initial ramp IR is the same for both FIGS. 15 and 16, which, as discussed above, can be pre-selected to be the fastest rate at which the actuator 20 can open the choke valve 111. Thus, the rate at which the choke valve 111 is opened during the initial ramp IR is independent of the measured first and second temperatures T1, T2.

Furthermore, by comparing FIGS. 15 and 16, it can further be seen that the duration of the intermediate ramp MR is dependent on both of the measured first and second temperatures T1, T2 (as discussed above). It can also be seen that the rate at which the choke valve 111 is opened during the intermediate ramp MR is dependent on the both of the measured first and second temperatures T1, T2 (as discussed above). Regarding the final ramp FR, it can be seen that both the duration and the rate at which the choke valve 111 is opened during the final ramp FR is dependent on the measured first temperature T1.

Finally, the second choke valve opening stage COS2 of FIG. 15 (i.e., the cold engine start) takes a total time t3 to complete while the second choke valve opening stage COS2 of FIG. 16 (i.e., the hot engine start) takes a total time t4 to complete. It can be seen that t4 is significantly less than t4. Thus, the total time of the second choke valve opening stage COS2 is dependent on the measured first and second temperatures T1, T2 are the same.

It should be noted that the graphs of FIGS. 11-12 and 15-16, while accurately depicting the data of the relational data tables discussed above, are not to scale. As can be seen from the data values of the relational data tables discussed above, it would not be reasonably possible to clearly depict the ramps in a single page if they were scale.

Referring now to FIGS. 21-24 concurrently, an integrated ignition and auto-choke module 3000 in accordance with the present invention is illustrated installed on an air-cooled internal combustion engine 100. The integrated ignition and auto-choke module 3000 comprises the electronic auto-choke control system 1000 described above with respect to FIG. 1 and is configured to carry out the method of FIG. 2. The electronic auto-choke control system 1000 of the integrated ignition and auto-choke module 3000 includes the actuator 20, the controller 10 (which comprises the processor 11 and memory device 12), the first temperature sensor 30, the second temperature sensor 40, the motor driver circuit 160, and the electrical connection/communication pathways 51-54, as discussed above. The functioning and structure of the electronic auto-choke control system 1000 in the integrated ignition and auto-choke module 3000 is the same as described above and, thus, requires no further description. It should be noted, however, that the second temperature sensor 40 may be omitted in certain arrangements.

The integrated module and auto-choke module 3000 further comprises an ignition circuit 4000, which generally comprises a charging coil 4010, a conditioning circuit 4020, an energy storage device 4030, a switch 4040, an ignition coil 4050, and a steel lamination stack 4070. The charging coil 4010, the conditioning circuit 4020, the energy storage device 4030, the switch 4040, and the ignition coil 4050 are in operable cooperation with one another, and with the controller 10, via the electrical connection/communication pathways 56-60. The steel lamination stack 4070 is operably positioned relative to the charging coil 4010 as described below.

In the exemplified embodiment, the charging coil 4010 can be conceptually considered an engine speed sensor that, in response to the magnet 127 of the flywheel 126, generates an electric charge due to a magnetic path being formed in the steel lamination stack 4070. Specifically, the charging coil 4010 surrounds a central leg (not visible) of the steel lamination stack 4070 and, as the magnet 127 on the flywheel 126 severs the magnetic flux in the steel lamination stack 4070 as it passes, a magnetic path is formed within this central leg that, in turn, generates the electrical charge in the charging coil 4010. This induced electric charge not only provides a pulse charge to the energy storage device 4030 (which may be a high voltage capacitor), but is also received/detected by the controller 10 (after conditioning by the conditioning circuit 4020). Based on the timing of the electric pulses generated by the charging coil 4010, the controller 10 determines the rotational speed of the engine. The charging coil's electric pulses are conditioned to provide a signal acceptable to the processor 11, as shown in the current diagram. In other arrangements, such as when the ignition module is not a magneto ignition system, a rotation sensor may be provided that is a component other than and/or in addition to the charging coil 4010 that can detect rotation of the engine through mechanical, electrical or magnetic detection, potentially through proper coupling to a crankshaft or a camshaft.

The electrical connection/communication pathways 56-60 can comprise, without limitation, electrical wires, fiber-optics, communication cables, wireless communication paths, and combinations thereof. The exact structural nature and arrangement of the electrical connection/communication pathways 56-60 is not limiting of the present invention, so long as each of the electrical connection/ communication pathways 56-60 can facilitate the desired operation, transmission, communication, powering, and/or control between the coupled elements/components, as described in greater detail below.

The integrated ignition and auto-choke module 3000 further comprises a housing 3010 (schematically illustrated in FIG. 21) that contains the ignition circuit 4000 and all of the elements/components of the electronic auto-choke control system 1000, with the exception of the actuator 20. Conceptually, the ignition circuit 4000, in combination with the housing 3010, can be considered to be an ignition module. As exemplified, the ignition module is a magneto ignition system.

By positioning the electronic auto-choke control system 1000 and the ignition circuit 4000 within the same housing 3010 as described herein, a single unit is created that can be mounted to the engine block 120 (specifically to the engine crankcase 123) in a single step. In the exemplified arrangement, the integrated ignition and auto-choke module 3000 can be mounted to the engine block 120 by coupling the steel lamination stack 4070 thereto via bolts or other fasteners. The steel lamination stack 4070 is, in turn, coupled to the housing 3010, thereby facilitating mounting of the entire integrate module 3000 to the engine block 210.

In addition to controlling the auto-choke control system 1000, the controller 10 can be configured to control the ignition circuit 4000, such as by controlling the timing for firing the spark plugs 4060. For example, the controller 10 may adjust the firing angle (retard firing) and optimize ignition timing when choking the engine. The housing 3010 can define a single internal cavity or can include internal walls that divide the internal cavity into multiple chambers. Additionally, the housing 3010 may be a fully enclosed housing or a partially enclosed housing having at least one open side. In the exemplified arrangement, the housing 3010 includes a potting compound 4080 that seals the interior thereof, along with the components enclosed therein.

As exemplified, the controller 10 and the motor driver circuit 160 are fully disposed within an interior cavity the housing 3010. The first temperature sensor 30, however, protrudes from the housing 3010. More specifically, the first temperature sensor 30 protrudes from the housing 3010 and is coupled to the steel lamination stack 4070 so as to be in thermal coupling therewith. In one arrangement, the first temperature sensor 30 may be embedded in the steel lamination stack 4070. As a result of being coupled to (which includes embedding) the steel lamination stack 4070, the first temperature 30 measures the temperature of the steel lamination stack 4070, which in turn becomes heated (and cooled) in a manner corresponding to the engine block 120 due its thermal cooperation therewith. Thus, the first temperature sensor 30 measures the engine block temperature.

The second temperature sensor 40 also protrudes from the housing 3010 so that at least a portion of the second temperature sensor 40 remains exposed to the surrounding environment. This allows the ambient air 150 that enters the blower housing 500 to come into contact with the second temperature sensor 40. As a result, despite being part of the ignition module, the second temperature sensor 40 can still measure the temperature of the ambient air flow 150. In certain arrangements of the integrated ignition and auto-choke module 3000, the second temperature sensor 40 may be located entirely outside of the housing 3010 and may even be omitted.

The integrated ignition and auto-choke module 3000 is mounted to the engine block 120 adjacent the flywheel 126. Specifically, the integrated ignition and auto-choke module 3000 is mounted to the engine crankcase 123 adjacent the flywheel 126, for example, by the steel lamination stack 4070 as described above. A magnet 127 is provided on the flywheel 126. During rotation of the flywheel 126 about the crankshaft 128, the magnet 127 passes the ignition module steel lamination 4070 cutting the magnetic flux lines and creating a magnetic field in the central leg that causes charging coil 4010 to generate a high voltage supply that charges the energy storage device 4030, which may be a high voltage capacitor. The switch 4040, which is in the form of a semiconductor-controlled rectifier, transfers the energy stored in the energy storage device 4030 to the primary 4051 of the ignition coil 4050, thereby creating a magnetic field that charges the secondary 4052 of the ignition coil 4050. As a result of the secondary 4052 being charged, the spark plug 4060 is fired/sparked.

The controller 10, through its monitoring of the rotational speed and rotation positioning of the engine (via for example the position of the engine crankshaft and/or camshaft), synchronizes the spark of the spark plug 4060 with the engine rotation. The conditioning circuit 4020 performs the following functions: (1) optimization of the gate current of the switch 4040 for all the RPM range; (2) filters parasitic strikes occurring on the sensor signal; and/or (3) ensures the correct lead angle. While the ignition circuit 4000 is exemplified as a capacitive discharge ignition, it is to be understood that various types of ignition circuits can be incorporated into the integrated ignition and auto-choke module 3000 in accordance with the present invention, such as an inductive discharge ignition. Additionally, while a magneto ignition system is exemplified, the integrated ignition and auto-choke module 3000 may comprise other types of ignition systems, such as a battery and coil-operated ignition, a mechanically timed ignition, and an electronic ignition.

Figure 23:
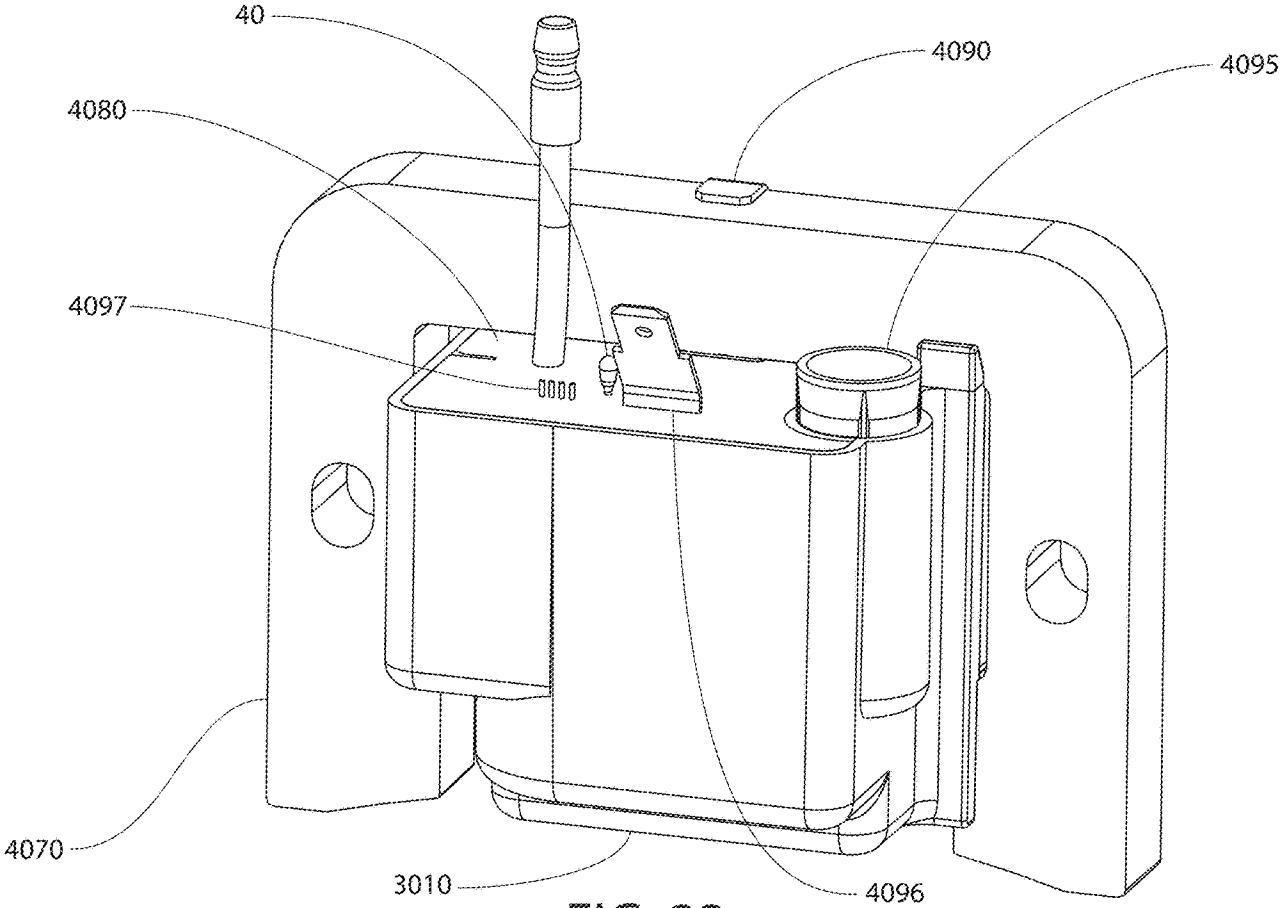
FIG. 23 is a perspective view of an exemplary structural arrangement of the integrated ignition and electronic auto-choke module of FIG. 19 in accordance with the present invention.
Figure 24:
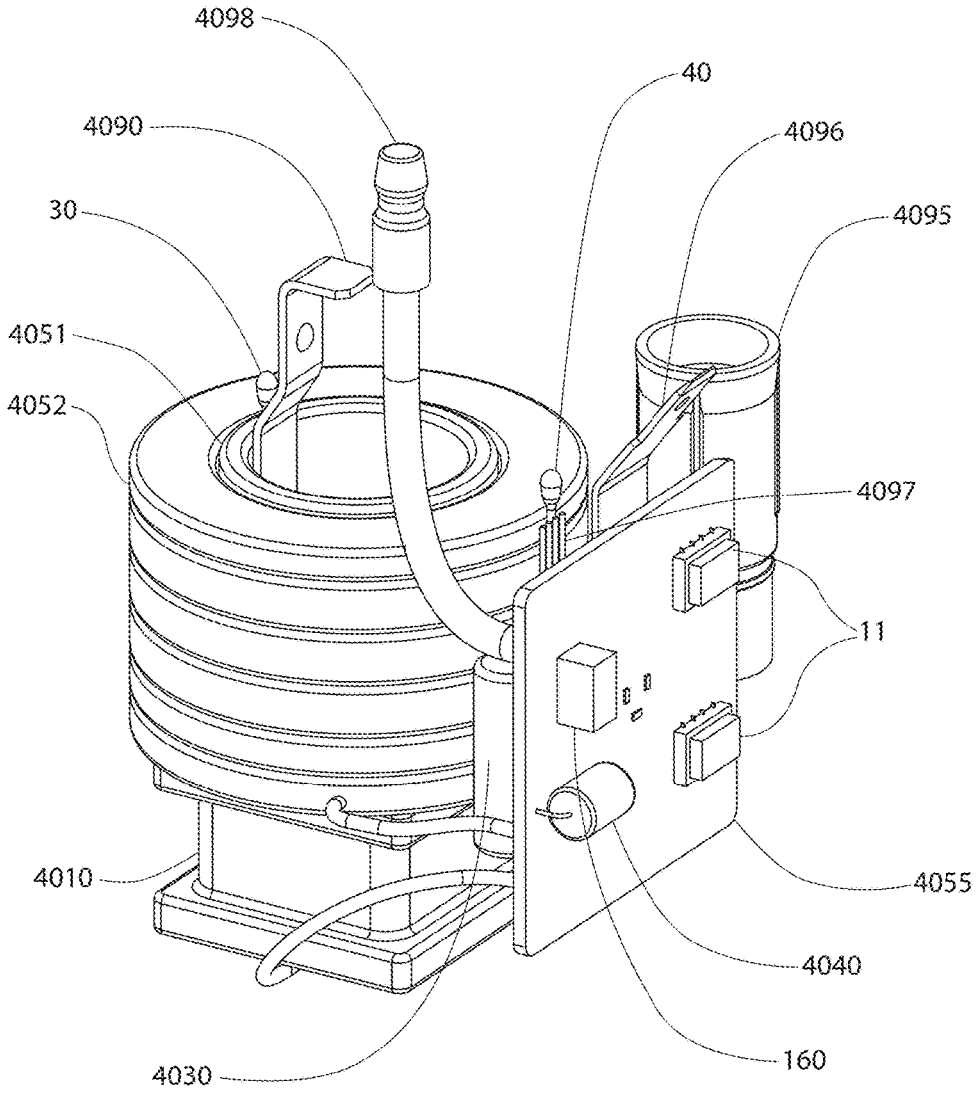
FIG. 24 is a perspective view of the internal components of the integrated ignition and electronic auto-choke module of FIG. 23 removed from the housing, in accordance with the present invention.

As exemplified in FIGS. 23-24, the controller 10 comprises two processors 11, which are mounted to a circuit board 4055, along with the motor driver 160, the switch 4040, the energy storage device 4030 and a shut-off terminal 4096. Additionally, a ground tab 4090 is also provided. The ground tab 4090 is coupled to the steel lamination stack 4070, which acts as the ground through its coupling to the engine block 120. A power in line 4098 is also provided for receiving 12V power. Leads 4097 protrude from the potting compound 4080 of the housing 3010 for connection to the motor/DLA. Similarly, a high voltage secondary lead 4095 also protrudes from the housing 3010 for electrically coupling to the spark plug boot and terminal.

Figure 22:
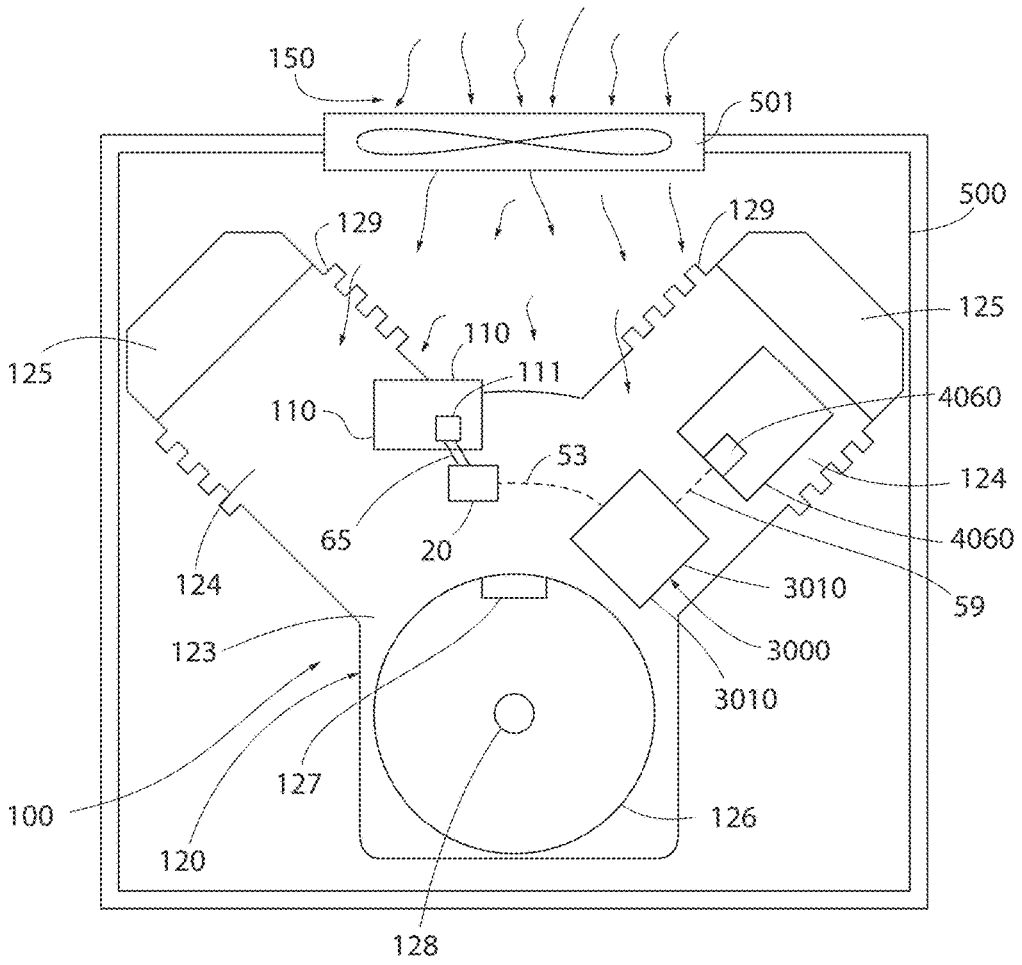
FIG. 22 is a schematic of an air-cooled internal combustion engine in accordance with the present invention, wherein the integrated ignition and auto-choke module of FIG. 19 has been installed thereto.

As mentioned above, the internal combustion engine 100 exemplified in FIG. 22 is an air-cooled engine and thus comprises a plurality of heat conducting fins 129 extending from the cylinder banks 124. Moreover, the internal combustion engine 100 is positioned within a blower housing 500 that comprises a blower 501 that draws in and forces an ambient air flow 150 over the internal combustion engine 100, including over the second temperature sensor 40 and into the carburetor 110.

Figure 25:
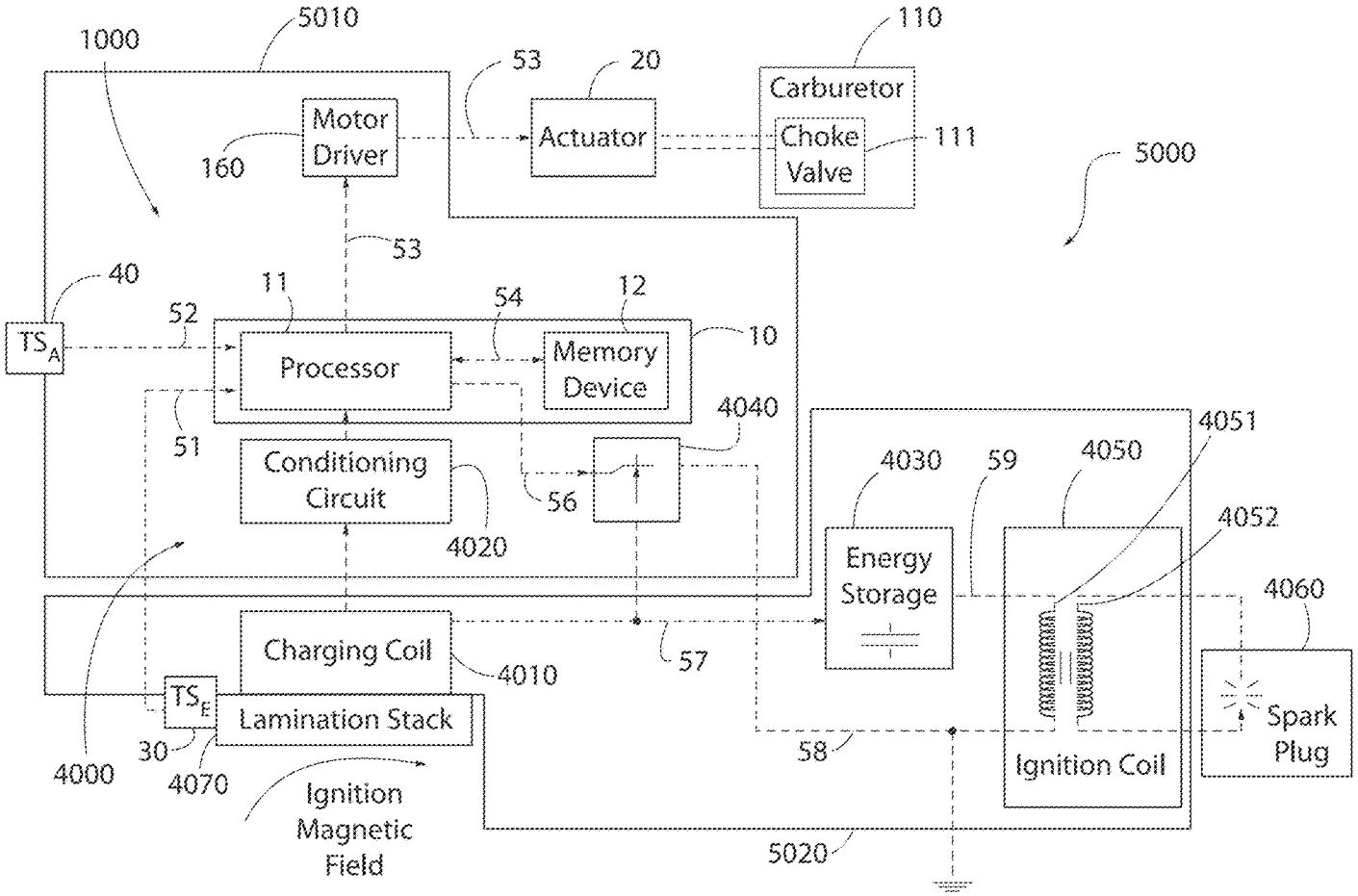
FIG. 25 is a schematic of another integrated ignition and electronic auto-choke module in accordance with the present invention.

Referring now to FIG. 25, a second arrangement of an integrated ignition and auto-choke module 5000 in accordance with the present invention is illustrated in schematic form. The integrated ignition and auto-choke module 5000 is similar to the integrated ignition and auto-choke module 3000 described above with the exception that the components and assemblies of the integrated ignition and auto-choke module 5000 are contained in a first housing 5010 and a second housing 5020, rather than in a single housing 3010 as is with the integrated ignition and auto-choke module 3000. Thus, the description of the integrated ignition and auto-choke module 3000 above is applicable to the integrated ignition and auto-choke module 5000, except as set forth below. While the components and assemblies of the integrated ignition and auto-choke module 5000 are spread between the first and second housings 5010, 5020 as exemplified, the integrated ignition and auto-choke module 5000 is still integrated in the sense that the controller 10 still controls the auto-choke control system 1000 in addition to controlling the timing for firing the spark plugs 4060.

The second housing 5020 contains the charging coil 4010. The lamination stack 4070 is coupled to the second housing 5020 and operably positioned/coupled with the charging coil 4010 as described above. The first temperature sensor 30 is also contained by the second housing 5020 in protruding manner so as to be coupled to the steel lamination stack 4070 as described above. The second housing 5020 also contains the ignition coil 4050, which includes the primary and second coils 4051, 4052 and the energy storage device 4030. The energy storage device 4030 may, however, be located with the first housing 5010 in certain other arrangements. The first housing 5010 comprises the remaining components as exemplified in FIG. 25 and described above for the integrated ignition and auto-choke module 3000.

In another arrangement of the integrated ignition and auto-choke module 5000 (which is not illustrated), the lamination stack 4070 may be coupled to the first housing 5010 while the charging coil 4010 is again contained by the first housing 5010, along with the first temperature sensor 30. In this arrangement, the energy storage device 4030 may also be contained by the first housing 5010. Thus, the second housing 5020 would only contain the ignition coil 4050 (which includes the primary and secondary coils 4051, 4052). The electrical energy of the energy storage device 4030 is transferred to the ignition coil 4050 via external wiring. The switch 4040 may be contained by the second housing 5020 rather than the first housing 5010. In an arrangement in which multiple spark plugs need to be fired in different engine cylinders (at different times), the second housing 5020 may contain multiple ignition coils 4050, one for each spark plug that needs to be fired.

In other arrangements in which the ignition coils 4050 are separated from the controller package, a lamination may be provided for each ignition coil 4050 to optimize energy transfer so it does not have to be external. In such a situation, a small lamination internal to the coil body (similar to an automotive coil) may be used. The secondary coils 4052, in such cases, could be combined such that both ends of the secondary coils 4052 are connected to the separate cylinder spark plugs and the coil fires in a waste spark mode such that even though both coils fire, only one is firing in the cylinder that is under combustion. Such control may be effectuated by the controller 10. If, however, the coils were energized by a battery instead of a magnet this control could be made simpler as the battery could charge the coils rather than charging a capacitor.

Referring back to FIG. 1, it is disclosed that in certain arrangements, the electronic auto-choke system 1000 may comprise a feedback sensor configured to measure a parameter indicative of an air-to-fuel ratio of an air-fuel mixture to be or being combusted in the internal combustion engine. As will be discussed in greater detail below, this feedback sensor can be operably coupled to the controller 10 to form a closed feedback loop from which the rate and/or position of the choke valve 111 can be dynamically controlled (in response to measurements taken by the feedback sensor, which may be in substantially real-time) during the second choke opening stages COS2. In the illustrated example, the feedback sensor is exemplified as an exhaust gas sensor 50, which may be an oxygen concentration sensor that measure oxygen content in the exhaust gases being expelled from the combustion chamber 121. In other arrangements, the feedback sensor may be an appropriate sensor, such as an oxygen concentration sensor, that is positioned in the air-fuel mixture prior to being combusted in the combustion chamber 121, such as within the carburetor 110 or in the air-fuel mixture supply passageway extending from the carburetor 110 to the combustion chamber 121. In still a further arrangement, the feedback sensor may be a barometric pressure sensor in the carburetor float which would determine fuel pressure in the intake. In such an arrangement, the rate of choke opening can be changed dynamically if the throttle valve is moved or if the fuel pressure changes while the choke is still ramping. A quick throttle-change may cause smoke issues if the choke is still in the Initial ramp or the Intermediate ramp cycles. A throttle position sensor may also be used.

In certain aspects of the invention, when such a feedback sensor is utilized, the movement characteristics (such as rate and/or position) of the choke valve 111 during the second choke opening stage COS2 are dependent on the real-time measurements of the feedback sensor. In one such an arrangement, the movement characteristics (such as rate and/or position) of the choke valve 111 during the second choke opening stage COS2 can be independent of the first and second temperatures T1, T2. Thus, the first and second temperature sensors 30, 40 may be omitted. In other arrangements, the movement characteristics (such as rate and/or position) of the choke valve 111 during the second choke opening stage COS2 may additionally be dependent on at least one of the first and second temperatures T1, T2, in addition to the measurements taken by the feedback sensor.

An exemplary method of dynamically controlling the opening of a choke valve 111 during an engine start-up event using such a feedback sensor will now be described. As a threshold matter, the controller 10 may perform the first choke valve opening stage COS1 as discussed above, thereby moving the choke valve 111 from the initial position to the starting position (assuming that the initial and starting positions are not equal). The starting position may be dependent on the first temperature T1 as discussed above in one arrangement or may be predetermined and be independent of the first and second temperatures T1, T2 in another arrangement.

Either way, once the choke valve 111 is in the starting position (which may be one of the reduced starting positions as discussed above), the controller 10 initiates the second choke opening stage COS2. At the beginning of and during the second choke opening stage COS2, the controller 10 repetitively receives signals from the feedback sensor that are indicative of the measured parameter. These signals may be received continuously during the second choke opening stage COS2 and may be real-time measurements taken during movement of the choke valve 111 from the starting position toward the fully-open position. Upon receipt of these signals, the controller 10 determines characteristics of the movement of the choke valve 111 based on the most-recently received signal. In other words, the characteristics of the movement of the choke valve 111 are dependent on the most-recent measurement taken by the feedback sensor. In one aspect, the controller 10 determines the rate at which the choke valve 111 is to be moved toward the fully-open position based a most-recently received signal from the feedback sensor. The characteristics of the movement of the choke valve 111 can be determined by the controller 10 utilizing a relational data table(s) (or algorithm) that includes the measured parameter as a variable (similar to that discussed above for the first and second temperatures T1, T2).

Utilizing the actuator 20, the controller 10 then moves the choke valve 111 toward the fully-open position in accordance with the characteristics of the movement most-recently determined by the controller 10. In one arrangement, the controller 10 moves the choke valve 111 toward the fully-open position at the rate that has been most-recently determined. As a result of the movement (and adjustments in the characteristics of the movement) of the choke valve 111 during the second choke valve opening stage COS2, the parameter being measured by the feedback sensor may change. However, because the feedback sensor is in a feedback loop with the controller 10 during the entirety of the second choke valve opening stage COS2, the controller 10 will dynamically adjust the characteristics of the movement of the choke valve 111 based on the most-recently received measurements. Thus, substantially real-time adjustments of the characteristics of the movement of the choke valve 111 can be made to ensure optimal air-to-fuel ratio for the air-fuel mixture to be or being combusted. Thus, in this case, the second choke valve opening stage COS2 may be considered a dynamic choke opening stage.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. An integrated ignition and electronic auto-choke module comprising:

a housing configured to be mounted to an engine block of an internal combustion engine; adjacent a flywheel;

the housing at least partially containing:

a first temperature sensor configured for measuring a first temperature indicative of an engine temperature;

a controller operably coupled to the first temperature sensor via a communication pathway, the controller configured to: determine a starting position of a choke valve based on the first temperature; and operate an actuator to move the choke valve into the starting position during a first choke opening stage; and an ignition circuit a lamination stack, the lamination stack configured to be coupled to the engine block and to the housing to mount the housing to the engine block wherein the first temperature sensor is coupled to the lamination stack and protrudes from the housing and wherein the controller is fully disposed within an interior of the housing.

2. The integrated ignition and electronic auto-choke module according to claim 1 wherein the ignition circuit comprises, in operable cooperation, an ignition coil, a charging coil, an energy storage device, and a switch, each of which is positioned within an interior cavity of the housing.

3. The integrated ignition and electronic auto-choke module according to claim 2 further comprising a potting compound that seals the interior cavity of the housing.

4. The integrated ignition and electronic auto-choke module according to claim 2 wherein the controller, which is positioned within the interior cavity of the housing, is operably coupled to the charging coil and configured to determine rotational speed of the internal combustion engine.

5. The integrated ignition and electronic auto-choke module according to claim 1 wherein the ignition circuit is a magneto ignition system.

6. The integrated ignition and electronic auto-choke module according to claim 1 wherein the housing at least partially contains a second temperature sensor for measuring a second temperature indicative of an ambient air temperature, the second temperature sensor operably coupled to the controller.

7. The integrated ignition and electronic auto-choke module according to claim 6 wherein the second temperature sensor protrudes from the housing so that at least a portion of the second temperature sensor remains exposed outside of the housing.

8. An internal combustion engine comprising:

an engine block;

a combustion chamber that receives a fuel mixture;

a choke valve for adjusting a fuel-to-air ratio of the fuel mixture received by the combustion chamber; and an integrated ignition and electronic auto-choke module comprising a housing configured to be mounted to the engine block, the housing at least partially containing:

a first temperature sensor configured for measuring temperature of the engine block as a first temperature;

a controller operably coupled to the first temperature sensor via a communication pathway, the controller configured to: determine a starting position of the choke valve based on the first temperature; and operate an actuator to move the choke valve into the starting position during a first choke opening stage; and an ignition circuit.

9. The integrated ignition and electronic auto-choke module according to claim 8 wherein the first characteristic is a rate at which the choke valve is moved during the first ramp.

10. An internal combustion engine comprising:

an engine block;

a combustion chamber that receives a fuel mixture;

a choke valve for adjusting a fuel-to-air ratio of the fuel mixture received by the combustion chamber; and an integrated ignition and electronic auto-choke module comprising a housing configured to be mounted to the engine block, the housing at least partially containing:

a first temperature sensor configured for measuring temperature of the engine block as a first temperature;

a controller operably coupled to the first temperature sensor via a communication pathway, the controller configured to: determine a starting position of the choke valve based on the first temperature; and operate an actuator to move the choke valve into the starting position during a first choke opening stage; and an ignition circuit a second temperature sensor for measuring temperature of ambient air as a second temperature, the second temperature sensor operably coupled to the controller;

determine a first ramp for opening the choke valve from the starting position to a fully open position based on the first temperature and the second temperature; and operate the actuator to adjust the choke valve from the starting position to the fully open position in accordance with the first ramp.

11. The internal combustion engine according to claim 10 wherein the first temperature sensor is thermally coupled to an engine crankcase of the engine block adjacent a flywheel.

12. The internal combustion engine according to claim 11 wherein the integrated ignition and electronic auto-choke module further comprises a lamination stack coupled to the housing, wherein the first temperature sensor is thermally coupled to the lamination stack, and wherein the lamination stack is thermally coupled to the engine block.

13. The internal combustion engine according to claim 10 wherein the ignition circuit comprises, in operable cooperation, an ignition coil, a charging coil, an energy storage device, and a switch, and wherein the controller is operably coupled to the charging coil and configured to determine rotational speed of the internal combustion engine.

14. The internal combustion engine according to claim 10 wherein the first ramp is based on a differential of the first temperature and the second temperature.

15. The internal combustion engine according to claim 10 wherein the housing at least partially contains the second temperature sensor, the second temperature sensor protruding from the housing so that at least a portion of the second temperature sensor remains exposed outside of the housing.

16. The internal combustion engine according to claim 10 further comprising a blower housing, the engine Hock located within the blower housing, the second temperature sensor exposed to an air intake stream of the blower housing.

* * * * *